US006873920B2

(12) United States Patent
Dunleavy et al.

(10) Patent No.: US 6,873,920 B2
(45) Date of Patent: Mar. 29, 2005

(54) OXYGEN FIRE AND BLAST FRAGMENT BARRIERS

(75) Inventors: Kim Dunleavy, Houston, TX (US); Charles J. Oswald, San Antonio, TX (US)

(73) Assignee: Air Liquide Process and Construction, Inc., Houston, TX (US)

( * ) Notice: Subject to any disclaimer, the term of this patent is extended or adjusted under 35 U.S.C. 154(b) by 0 days.

(21) Appl. No.: 10/271,159

(22) Filed: Oct. 15, 2002

(65) Prior Publication Data

US 2003/0167726 A1 Sep. 11, 2003

Related U.S. Application Data

(60) Provisional application No. 60/329,830, filed on Oct. 15, 2001, and provisional application No. 60/329,829, filed on Oct. 15, 2001.

(51) Int. Cl.[7] ..... G06F 19/00; E04C 2/32

(52) U.S. Cl. ..... 702/42; 52/202; 52/783.13; 52/784.11; 89/36.01; 89/36.04

(58) Field of Search ..... 702/33, 41, 42, 702/43, 44, 138, 140; 73/82, 760, 783, 786, 804, 794, 795, 788, 789, 841; 703/7; 89/36.01, 36.04; 52/74.13, 202, 783.13, 784.11

(56) References Cited

U.S. PATENT DOCUMENTS 4,763,457 A * 8/1988 Caspe ..... 52/504
5,749,140 A * 5/1998 Polito et al. ..... 29/527.1
6,216,579 B1 * 4/2001 Boos et al. ..... 89/36.02
6,289,781 B1 * 9/2001 Cohen ..... 89/36.02
6,298,766 B1 * 10/2001 Mor ..... 89/36.04
6,358,603 B1 * 3/2002 Bache ..... 428/323
6,574,930 B2 * 6/2003 Kiser ..... 52/232
6,581,505 B1 * 6/2003 Levell ..... 89/36.07
6,651,011 B1 * 11/2003 Bache ..... 702/33
2004/0025453 A1 * 2/2004 Coddens ..... 52/202
2004/0049356 A1 * 3/2004 Bache ..... 702/33
2004/0107827 A1 * 6/2004 Edberg et al. ..... 89/36.04
2004/0118272 A1 * 6/2004 Edberg et al. ..... 89/36.04

* cited by examiner

*Primary Examiner*—Patrick Assouad
(74) *Attorney, Agent, or Firm*—Linda K. Russell

(57) ABSTRACT

A blast fragment and oxygen fire safety barrier comprising a corrugated impact panel connected to and spanning a pair of columns designed by directly impacting the barrier with a fragment of specified weight at a specified velocity to obtain test values for use in determining whether the barrier is capable of absorbing impact kinetic energy (KE) without exceeding predetermined maximum allowable ductability and maximum allowable deflection to span ratios, and dissipating strain energy at such maximum allowable deflection, and whether connectors have sufficient shear strength considering the lesser of maximum dynamic shear capacity of said column and a maximum dynamic shear force based on measured peak reaction during direct fragment impact on the column, includes an oxygen fire resistant panel on the non-blast side of the impact panel spaced from said impact panel a distance in excess of the maximum allowable deflection of said impact panel.

17 Claims, 7 Drawing Sheets

OXYGEN FIRE AND BLAST FRAGMENT BARRIERS

CROSS REFERENCE TO RELATED APPLICATIONS

This application claims priority to U.S. Provisional Applications 60/329,830 and 06/329,829, both filed Oct. 15, 2001.

FIELD OF THE INVENTION

This invention relates to oxygen fire and oxygen fire/fragment barriers useful in air separation plants.

BACKGROUND

Air separation plants operate at high pressures and have potentially hazardous equipment that should be considered for enclosure by barriers. The primary purpose of a safety barrier is to prevent injury to personnel. A secondary purpose is to prevent or lessen damage to adjacent equipment. Of particular concern are barriers where oxygen services are involved. Oxygen flash fires and/or blowouts are much different in temperature, intensity and fuel from a 48 hour petroleum refinery or petrochemical plant fire. In refinery or petrochemical fires, the fuel is hydrocarbons exhausting through metal such as pipes and tanks, and temperatures can reach as high as 1800° F. In an oxygen fire, the fuel is metal itself. These fires burn at extremely high temperatures of 5500° F. and higher.

The Industrial Gas Council ("IGC") of the European Industrial Gas Association has published document 1142-6829, 27-01-E, "*Centrifugal compressors for oxygen service: code of practice*." According to the IGC, an oxygen fire most often starts in areas of high component or gas velocity. The most likely sites are around the impeller or recycle valve. Bum through is most likely to occur at places close to the seat of the fire where gas pressure is high and the thermal mass is small, such as the compressor casing, the compressor shaft seals, expansion bellows adjacent the casing/volute, first and second bends in the process pipework upstream and downstream from the compressor flanges, and the recycle valve and its associated outlet pipe and first downstream bend. A jet of flame is accompanied by a widening spray of molten metal which splatters over a wide area. A blast can collapse a barrier if the barrier is not engineered to withstand the blast in the context of its surroundings. The release of pressure and the rotational energy of a centrifugal rotor accelerates projectiles which either pass through holes burned in the compressor casing or rip holes in the casing and go on to hit the safety barrier.

Thus, in general, there are three types of mechanical forces to be considered in designing a barrier: (i) force of a jet resulting from release of compressible fluid as from a hole in a compressor casing or pipework accompanied by molten metal issuing from a hole, (ii) an overpressure or blast force from massive release of stored energy, such as stored inventory of oxygen or hot combustion gases, and (iii) force resulting from the impact of steel projectile blast fragments traveling a high velocity as a result of a blast. Further, design of a safety barrier to withstand an oxygen fire must enable it to standup to thermal loads of 5500° F.-plus temperatures at the location of metallic combustion and molten metal splatter.

In addition to IGC document 27/01/E, another relevant reference is *Oxygen Compressor Installation and Operation Guide, a standard for current industrial practices for oxygen compressor installations, operations, maintenance, and safety*, publication number G-4.6 (1992), issued by the Compressed Gas Association ("CGA"), 4221 Walney Road, 5th Floor, Chantilly, Va. 20151-2923. Both these guides allude to fragmentation safety barriers around centrifugal compressors in oxygen service. The CGA document G4-4.6 at art. 4.2.2.1(c) makes reference to "the impact of system components that may be ejected" but does not specify a load parameter. The IGC document 27/01/E, re-issued in December of 2000, mentions a use of 30 kilograms (kg) at 50 meters per second (m/sec) irrespective of compressor duty. A mechanical load of 30 Kg at 50 m/sec is the equivalent of a 66 pound projectile moving at 164 ft/sec (112 miles per hour).

Air separation plants built and upgraded over the last 50 years are typically a composite of evolving engineering practices. Barriers and protective enclosures of the most recently engineered oxygen compressor installations are commonly erected using steel reinforced concrete. However, there are many existing indoor centrifugal oxygen compressors installed with barrier enclosures constructed of structural steel and undefined or untested insulation. These are of questionable strength and may not be in compliance with CGA G4-4.6; they have a questionable capacity to impede imparted fragments from a compressor failure.

Retrofit or upgrading of existing centrifugal compressor installations for barriers that would be in compliance with CGA G4-4.6 and Industrial Gas Council document 27-01-E presents numerous problems. Engineering solutions for an existing plant may be limited by the arrangement of the installed compressor and piping systems for which an upgraded barrier is to be erected. For example, in the case of centrifugal compressors, compressor rotating components typically are located on intermediate or mezzanine stories of buildings above heat exchangers and other pipework. The support columns for these upper levels may not have been placed—and the columns or the floor on which the rotating components are mounted may not have been engineered—to take the additional load of reinforced concrete walls added as a barrier upgrade to the mezzanine floor. Further, any barrier membrane capable of impeding a 66 pound projectile moving at 164 ft/sec would transfer the membrane load to the barrier structural steel, and the barrier structural steel would transfer that load to the existing structural steel of the building. If the barrier structural steel suffered a direct hit from the fragment, maximum loads would be transferred to the building structural steel. While fragment barriers intended for new construction can have building steel and concrete engineered to take any transferred blast fragment load, the same is not true of existing buildings; in them the building steel and concrete may not have the capacity to take the high transferred loads. Thus it is necessary to understand the maximum loading that structural steel barriers will receive and transfer.

In addition to constraints from existing building structure, use of reinforced concrete as an upgrade barrier material is often not feasible because of density and congestion of oxygen system installations, including compressors, compressor gas coolers and interstage piping, piping to and from a compressors including recycle piping, oil piping and other lubricant lines or service lines for rotating equipment, etc. The compressor and pipework may require location of protective barriers in locations where a reinforced concrete wall cannot be fitted.

Apart from ability to protect against blast fragments, a fire barrier for an oxygen system must be able to stand up to the terrific heat of an oxygen fire. While concrete can do this, to a point, the oxygen handling industry has had trouble in certifying other materials as able to withstand the heat of an oxygen fire. Many industry standards exist, but none represent the conditions of an oxygen flash fire where metal is a fuel and metal splatter burns through materials. The capacity of materials alternative to concrete to impede oxygen metal fires is largely unknown.

Wholly apart from serving as a fire barrier, a basic need exists for safety barriers and a method for designing them for air separation and other high pressure gas processing plants to be able to withstand a projectile impact of substantial size and velocity produced by sudden release of pressure, whether or not the pressurized gas is combustible, where use of reinforced concrete walls is not feasible. This includes the need to understand all possible dynamic loads from a blast fragment, and in respect to loads on a steel membrane, to understand energy absorbed by a deformed membrane, loads transferred from the barrier membrane to barrier structural steel, and loads transferred from the barrier structural steel to the building structural steel or concrete, since existing building structural steel might not accept the transfer of loads received by a structural steel barrier. Where the pressurized gas is combustible, such as oxygen, there is the further need that a safety barrier that is not steel reinforced concrete not only will stand up to a blast fragment of considerable mass and speed but also will stand up to extremely high temperatures without ignition or burn through. Advantageously, such safety barrier structures would be one suitable for use both in new construction and for retrofit and upgrading of existing plants. In the latter respect, a desirable fragment barrier system would not have undue weight and/or bulk and would not function so as to exceed safety margins of structural steel already in place in an existing building.

SUMMARY OF THE INVENTION

This invention provides at least a blast fragment and optionally also an oxygen fire safety barrier comprising a corrugated impact panel connected to and spanning a pair of columns designed by directly impacting the barrier with a fragment of specified weight at a specified velocity to obtain test values for use in determining whether the barrier is capable of absorbing impact kinetic energy without exceeding predetermined maximum allowable ductability and maximum allowable deflection to span ratios and dissipating strain energy at such maximum allowable deflection, and whether connectors have sufficient shear strength considering the lesser of maximum dynamic shear capacity of said column and a maximum dynamic shear force based on measured peak reaction during direct fragment impact on the column. Optionally, an oxygen fire resistant panel on the non-blast side of the impact panel is spaced from said impact panel a distance in excess of the maximum allowable deflection of said impact panel.

More particularly, this invention provides a method of designing a safety barrier to protect a facility from a blast fragment of specified weight moving at a specified velocity, comprising (a) selecting a corrugated impact panel having a thickness, rib height, rib spacing, and yield strength for and selecting a tubular column having a yield strength, wall thickness, depth and width, (b) directly impacting a barrier comprising the impact panel connected to and spanning a pair of the columns with the fragment of the specified weight at an allowable range of variance of the specified velocity to obtain test values including at least peak column reaction loads from such direct impact of the fragment on the column, (c) calculating whether such impact panel is capable of (i) absorbing kinetic energy (KE) applied by a midspan impact of the fragment, the impact panel acting as a one-way beam, without exceeding the more stringent of a predetermined maximum allowable ductability ratio and a predetermined maximum allowable deflection to span ratio for the impact panel, and (ii) dissipating a strain energy (SE) imparted into the impact panel at such maximum allowable deflection such that the ratio $$\frac{(SE - KE)}{KE}$$

is greater than minus 0.1 and if so, accepting the impact panel for use in a safety barrier, and (d) calculating whether the column is capable of (i) absorbing kinetic energy energy applied by midspan fragment impact, the column acting as a one-way beam, without exceeding the more stringent of a predetermined maximum allowable ductability ratio and a predetermined maximum allowable deflection to span ratio for the column, and (ii) dissipating strain energy at maximum allowable deflection, and if so accepting the column for use in a safety barrier with the impact panel, and (e) determining whether connectors for connecting the impact panel to the columns having sufficient shear strength considering the lesser of (i) maximum dynamic shear capacity of the column (Vcap) and (ii) a maximum dynamic shear force based on measured peak reaction during direct fragment impact on the column, and if so, accepting the connectors for use with the impact panel and columns in the safety barrier.

A safety barrier designed in accordance with the this method comprises an accepted impact panel, a pair of accepted columns and accepted connectors, the impact panel being connected to and spanning a pair of the columns.

Optionally the safety barrier further comprises at least one oxygen fire resistant panel spaced from the impact panel a distance in excess of the maximum allowable deflection of the impact panel Suitably the oxygen fire resistant panel is one tested for burn-through resistance by holding a test material outside a predetermined position for testing resistance of the material to burn-through, igniting to constant burn an exothermic burning bar having an oxygen exhaust end facing the predetermined position, moving the test material into the predetermined position, and advancing the ignited exothermic burning bar toward the test material at a speed effective to maintain the end of the burning bar at a constant predetermined spacing from the test material in the predetermined test position, and found to resist burn through for a predetermined suitable time.

The safety barrier so tested suitably is one in which in the test the predetermined position presents the test material in a plane substantially perpendicular to the oxygen exhaust end of the burning bar. In the burn through test, the test material suitably is lowered into the test position from a height over the test position. In an embodiment, the oxygen fire resistant panel is selected from steel clad panel and fiber cement board panels on the non-blast side of the impact panel, spaced from the impact panel a distance in excess of the maximum allowable deflection of the impact panel. Optionally, the safety panel of claim also further comprising at least one oxygen resistant panel selected from steel clad panel and fiber cement board panels supported on a blast side of the impact panel.

In an embodiment, the safety barrier is capable of resisting end on penetration of a fragment weighing about 30 kg traveling at about 50 m/sec. In an embodiment, the impact panel of the safety barrier is a corrugated steel panel having a steel minimum yield strength of about 50,000 psi, a minimum panel thickness of about 0.135 inches, a minimum panel rib height of about 2 inches and a maximum panel rib spacing of about 6 inches, and the columns are steel tube columns each have a minimum wall thickness of about 0.25 inch, a minimum depth of about 6 inches, and a maximum width of about 4 inches.

The invention further includes a method of protecting a facility from a blast fragment of specified weight moving at a specified velocity, comprising designing a safety barrier in accordance with the method described above and installing, between equipment which can be the source for a blast fragment and the facility to be protected, the barrier comprising an accepted panel, a pair of accepted columns and accepted connectors, the panel being connected to and spanning a pair of the columns. The method of protecting a facility is particularly useful where the facility includes a centrifugal oxygen compressor, and the method then further comprises protecting the facility from an oxygen fire, the barrier further comprising at least one oxygen fire resistant panel selected from steel clad panel and fiber cement board panels on the non-blast side of the impact panel, spaced from the impact panel a distance in excess of the maximum allowable deflection of the impact panel.

These and additional and other aspects of the invention will be further seen from the detailed description which follows, in which reference is in part made to drawings that are now described.

DETAILED DESCRIPTION OF THE INVENTION

The invention is described in detail in two principal sections, each of which sets forth testing methods and test results from which methodologies and structures are provided in accordance with this invention. The first section describes the testing methodology used to test various materials as oxygen fire barriers and gives the results of that testing for materials used in the oxygen fire resistant safety barriers of this invention.

Oxygen Fire Resistance

Oxygen fire resistance of test materials for use in a composite oxygen fire barrier was tested by obtaining a test material, holding the test material outside a predetermined position for testing resistance of the material to burn-through, igniting to constant burn an exothermic burning bar having an oxygen exhaust end facing the predetermined position, lowering the test material into the predetermined test position (a plane substantially perpendicular to the oxygen exhaust end of the burning bar) from a height over the test position, and advancing the ignited exothermic burning bar toward the test material at a speed effective to maintain the exhaust end of the burning bar at a substantially constant predetermined spacing from the test material in the test position.

A burning bar is a long, ferrous metal tube filled with ferrous or non-ferrous wire rods. In order to ignite the bar, the bar is first connected to a source of oxygen so that the oxygen can flow axially along the pipe. The open end of the bar is heated until the pipe wall and the wires contained within the pipe are ignited. Then the flow of oxygen is commenced. The oxygen combines with the iron and combustion of the metal forms iron oxide, giving off large amounts of heat in the process. This heat maintains the end of the tube at a sufficiently high temperature that the metal combustion process continues. The burning bar is consumed by the flame. Thus, the bar starts out at a given length and is consumed with the flame becoming closer and closer to the end of the pipe where the supply of oxygen is sourced.

Figure 1:
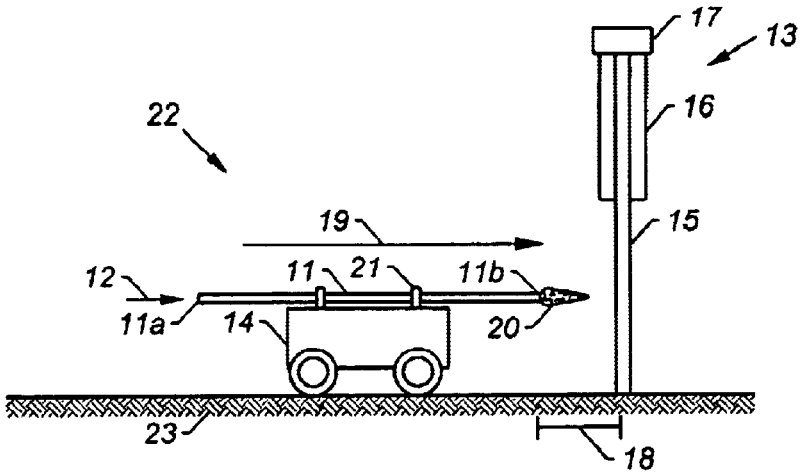
FIG. 1 is a diagrammatic side view of a test apparatus for testing oxygen fire burn through of test materials.
Figure 2:
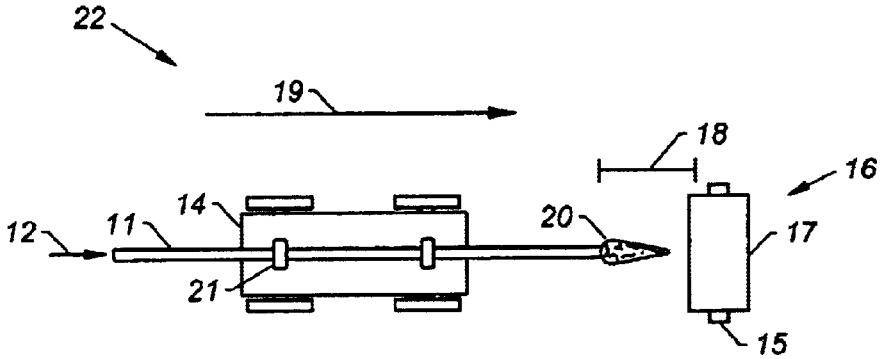
FIG. 2 is a diagrammatic top view of the apparatus of FIG. 1.
Figure 3:
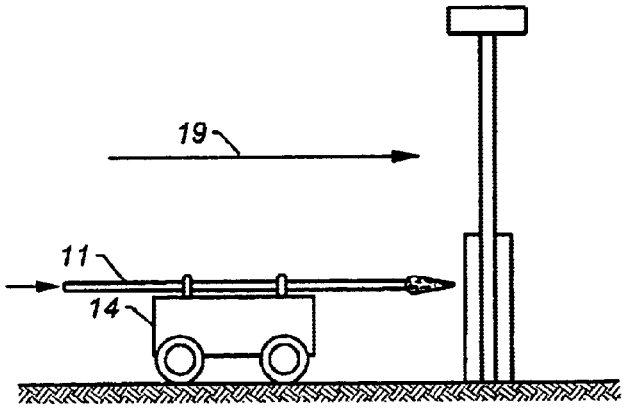
FIG. 3 is a diagrammatic side view of the apparatus of FIG. 1 in conduct of oxygen fire burn through testing.

The test apparatus and methodology used is schematically depicted in FIGS. 1–3. Referring to FIG. 1, reference numeral 22 indicates the apparatus, which includes a tractor 14, an exothermic burning bar 11, and a guillotine 13, that operates to test a test material 16. Guillotine 13 includes a rack system 15 and controller 17. Rack system 15 has a holder bracket and/or clasp for securing material 16. Controller 17 is pneumatically operated release for rack system 15.

Tractor 14 includes a holder 21 and a structure for locomotion 23, such as a wheel, a roller, a track, a slide and/or the like. Holder 21 can be any structure for securely holding burning bar 11. Oxygen is pumped and/or flowed through burning bar 11 about end 11*a* and ignited to produce a flame 20 about end 11*b*. Flame 20 is allowed to burn for a sufficient time to achieve a constant burn and/or flame, usually between one second and five minutes. Flame 20 will burn and/or melt burning bar 11 from end 11*b* towards end 11*a*. As burning bar 11 is melted, portions of bar 11 produce a molten metal splatter.

Burning bar 11 is positioned a determinable distance 18 from rack system 15. In the tests, the distance used was 12 inches, 6 inches, and 3 inches to zero inches.

Tractor 14 is positioned at distance 18 and then guillotine 13 releases material 16. Material 16 slides/moves to a position wherein it is intersected by a substantially horizontal line extending from flame 20. As bar 11 is burned from end 11*b*, it is moved and/or repositioned in direction 19 to maintain distance 18 substantially constant. This allows for a constant flame test. In addition, maintaining distance 18 allows portions of bar 11, as it melts, to be splattered on material 16, thereby rendering a more realistic test because in the event of an oxygen fire, metals are a fuel and metal spattering is incident to the fire.

FIG. 2 shows a top view of test system 22. In this view it can be seen that rack system 15 provides a channel and/or path for material 16. FIG. 3 shows the test system with material 16 in position perpendicular to the direction of the flame of burning bar 11, advancing in the direction 19 to maintain a substantially constant distance between the exhaust end 11*b* of the burning bar and the test material 16.

In the tests described below, the burning bar was a 10 foot length of a nominal ¾ inch diameter A513 tube made to a 1.050 inches OD, 0.824 inch I.D. and 0.113 inch wall thickness containing 36 mild steel wires of 0.12 inch diameter. The internal pipe ID surface area was 0.53 square inches and the combined internal pipe ID surface area and wire external surface area was 0.94 square inches. The burning bar was connected to a 200 psig oxygen supply. A welding tractor with clamps secured the burning bar horizontally and advanced along a gear toothed track. The tractor rate of advance was set to equal the burning bar consumption rate. The burning bar consumption rate measured at approximately 38 inches per minute regardless of oxygen supply pressure. Burning bar tip temperature was estimated at +5500° F. The burning bar was positioned at a distance of 6 inches or 12 inches (in two instances 0–3 inches) from a test material prior to burning bar ignition. The burning bar was ignited using an oxy-acetylene torch. After combustion stabilization, typically 1 to 2 seconds, the guillotine with a test material coupon was dropped in front of the burning bar. Time to penetration of test material coupon was measured. As a base comparison, burn-through time at a distance of 0 to 3 inches was determined for a 3.25 inch thick cement coupon, and found to be 46 seconds.

Tests were conducted on steel clad cement ("SCC") of three types, each of a particular thickness (type 1=0.393 inch thickness; type 2=0.5 inch thickness; type 3=0.375 inch thickness) and on fiber cement board ("FCB") types of several thicknesses (type 1=7/16 inch thick; type 2 in 5/16, 10/16 and 15/16 thicknesses). In some instances some types were layered to achieve additional thicknesses. Cement and ceramic window glass ("CG") of 3/16 inch thickness was also tested. The tests are summarized in the following table.

TABLE 1

Tests of Materials for Fire Panels

| Barrier Material | Layers | Thickness (inch) | Total Thickness | Distance (inch) | $O_2$ pressure (psig) | Burn-through time (sec.) |
|---|---|---|---|---|---|---|
| Cement | 1 | 3.25 | 3.25 | 0–3 inch | 200 | 46 |
| CG | 1 | 0.1875 | 0.1875 | 6 | 200 | 8.5 |
| CG | 1 | 0.1875 | 0.1875 | 12 | 200 | 45 |
| FCB type 1 | 1 | 0.4375 | 0.4375 | 6 | 200 | 5 |
| FCB type 1 | 1 | 0.4375 | 0.4375 | 12 | 200 | 15 |
| FCB type 1 | 2 | 0.4375 | 0.875 | 6 | 200 | 10 |
| FCB type 1 | 3 | 0.4375 | 1.3125 | 6 | 200 | 16 |
| FCB type 2 | 3 | 0.3125 | 0.9375 | 12 | 200 | 14 |
| FCB type 2 | 3 | 0.625 | 1.875 | 6 | 200 | 7 |
| FCB type 2 | 3 | 0.625 | 1.875 | 12 | 200 | 27 |
| FCB type 2 | 3 | 0.9375 | 2.8125 | 6 | 200 | 11 |
| FCB type 2 | 3 | 0.9375 | 2.8125 | 12 | 200 | 42 |
| FCB type 2 | 11 | 0.3125 | 3.5 | 0–3 | 200 | 26 |
| SCC type 1 | 1 | 0.393 | 0.393 | 6 | 100 | 5 |
| SCC type 1 | 1 | 0.393 | 0.393 | 12 | 100 | 25 |
| SCC type 1 | 2 | 0.393 | 0.787 | 6 | 100 | 11 |
| SCC type 2 | 1 | 0.5 | 0.5 | 6 | 200 | 10 |
| SCC type 2 | 1 | 0.5 | 0.5 | 12 | 200 | 45 |
| SCC type 2 | 2 | 0.5 | 1.0 | 6 | 200 | 25 |
| SCC type 2 | 3 | 0.5 | 1.5 | 6 | 200 | 40 |
| SCC type 3 | 1 | 0.375 | 0.375 | 6 | 100 | 10 |

In addition to the foregoing flame tests, other tested materials and results were as follows:

TABLE 2

Other Tested Materials

| Tested material | Result |
|---|---|
| Tempered glass, ceramic tile | shattered |
| Foamglas | Melted, disintegrated |
| Mineral Wool, fiberglas | Melted |
| HITLI joint sealant | Excellent molten splatter resistance |
| Aluminized Kelvar ® with insulation | Melted on contact, burned |
| Aluminized Kelvar ® | Excellent molten splatter resistance |

Fragment Impact Resistance

Impact Testing

Figure 5:
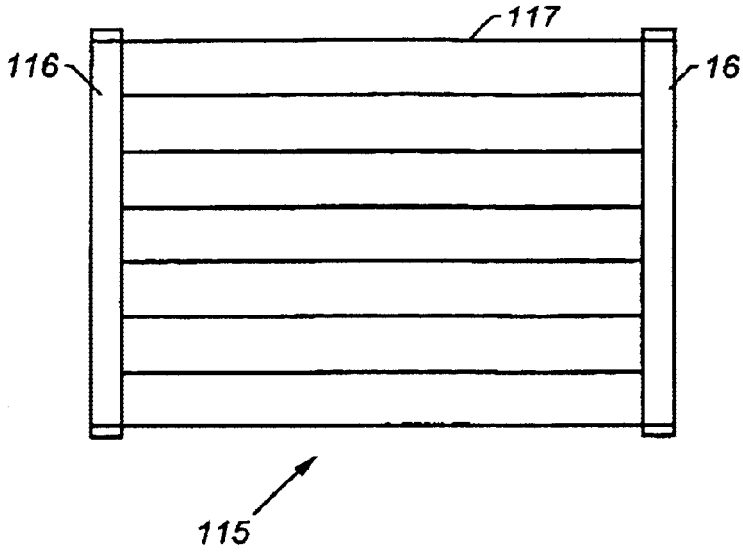
FIG. 5 is diagrammatic plan view of a fragment barrier.
Figure 6:
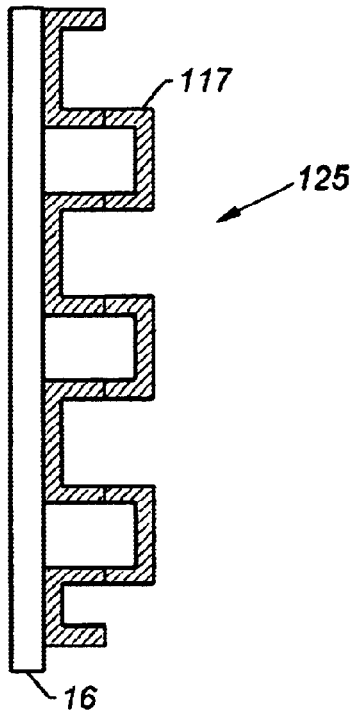
FIG. 6 is a diagrammatic side view of a fragment barrier.

Foreshadowing what follows in detail, preliminary and final proof tests were conducted for a barrier that stops a specified fragment threat from centrifugal oxygen compressor failure and a set of design specifications were developed for the barrier. Twelve preliminary one-half scale tests were conducted to verify that the barrier design concept was valid and to experimentally determine the approximate required size for barrier components. Two full-scale barriers were constructed from heavy corrugated steel plate (0.13 in to 0.18 in thick) bridge decking spanning 8 ft horizontally between vertical tube steel columns. Referring to FIGS. 5 and 6 for a diagrammatic representation of a fragment barrier indicated by reference numeral 125, panels 117 span between and are connected at their lateral ends to columns 116. The panels 117 together form a membrane indicated generally by reference numeral 115. A fragment barrier system of the present invention is designed with at least three plies so that it has a fire barrier material on both the impact side and the backside of the fragment barrier. This is because a fire event may precede or follow a blast fragment event. If the fragment barrier precedes a fire event, the blast side oxygen resistant panel(s) 127 (FIGS. 6, 7 and 8, about which see more below) provide resistance to an oxygen fire. Likewise, a fragment barrier is provided should an oxygen fire event include a blast event before or after the fire event starts.

In the tests, low strength fire resistant panels were screwed to both the sides of the corrugated steel plate.

The columns vertically spanned 9.5 ft. The full scale barriers were subjected to a total of six impact tests with a specified fragment threat. The corrugated panels on the test barriers were subjected to two impacts near midspan and two impacts near the supports. The barrier columns were subjected to fragment impacts midspan and near the supports. The full-scale test barriers resisted all fragment impacts without allowing fragment penetration. The tests indicated that there was some factor of safety against failure.

Figure 4A:
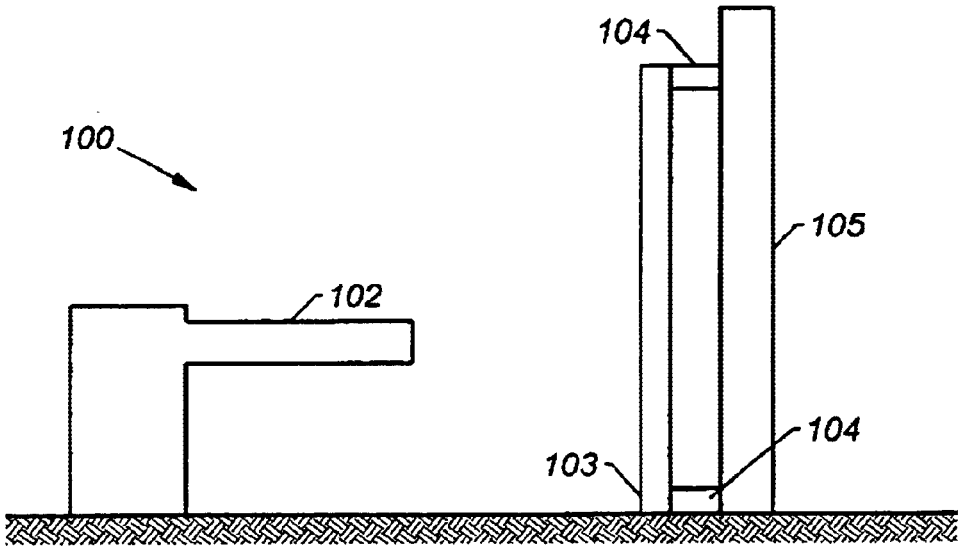
FIG. 4*a* is a diagrammatic of a test apparatus used to test fragment barriers in accordance with this invention.
Figure 4B:
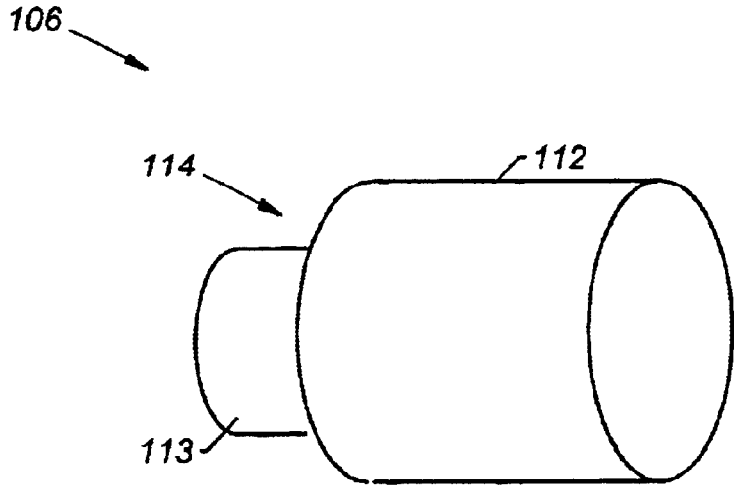
FIG. 4*b* is a diagrammatic view of a mock blast fragment.

The fragment weight and velocity for the full sized tests were 30 kg and 50 m/sec, respectively, based on the mention of that fragment weight and velocity in the Industrial Gas Council document 27-01-E described above. The preliminary tests used a weight of 8.15 lbs. The fragment was carried in a sabot. No guidance was available on the fragment shape that could be expected from failure of centrifugal oxygen compressors so a shape was chosen that is consistent with shapes used previously to simulate industrial accidents. In both tests the fragment was a flat-ended steel cylinder with a 3:1 length to diameter ratio impacting head-on. Referring to FIG. 4*b*, the general configuration of the fragment 106 is represented having a length to diameter ratio of 3 and comprised a body 112, and an impact member 113. Other shapes representing a worse fragment threat are possible but the methodology used in connection with the tested shape is useful in determining other design specifications. The blast gun was an air receiver approximately 3 feet in diameter and 3 feet long, pressurized to 15 lbs, separated from a 30 foot long barrel 12 inches in diameter by a mylar membrane 0.005 inches thick with a circumferential electrical element captured between flanges connecting the air receiver to the barrel. An electrical trigger instantly melted the mylar membrane instantly releasing the air in the receiver to shot the fragment into the test barrier at selected locations on the test barrier. FIG. 4*a* shows the general test set up involving a blast gun 102, fragment test barrier 103, load cells 104, and a barrier support structure 105 for the test barrier.

The impact locations were chosen to cause maximum flexural and shear stresses in the barrier components. Maximum dynamic and permanent deflections of the corrugated panel and column were measured in most of the full-scale tests, as well as dynamic reaction forces between the test barrier columns and the test frame. Comparisons between measured and calculated deflections and reaction forces showed that much of the observed response of the corrugated steel panel and barrier columns caused by midspan fragment impact can be modeled with simple design-oriented methods based on conservation of energy during first mode flexural response. However, the peak column reaction force from direct fragment impact on the column at midspan was significantly underpredicted by the equation for the maximum shear during first mode flexural response. The equation gives a reasonable upper bound for cases where the fragment impacts the panel near the column causing a more gradually applied load on the column, which does not excite the higher mode column response. The fact that all the response modes of the column and corrugated steel panel important for design cannot be modeled well with simple design-oriented methods means that barrier design must be based, in part, on full-scale test barriers that successfully stop the test fragment.

The detailed tests, test results, a description of the dynamic response of the barrier to fragment impact, and a description of a barrier design methodology developed as a result of the testing now follows, including a discussion of relevant equations for use in calculating the pertinent factors described in the design of a fragment barrier in accordance with this invention.

Preliminary Tests

A total of 16 one-half scale preliminary tests were performed. An 8.15 lb right cylindrical fragment, with a diameter of 2.3 inches and a length of 6.9 inches, was shot end-on at 50 m/sec velocity into barriers constructed with corrugated steel panels and a fire resistant panel attached on the impact side. Fire resistant panels were attached to both sides of the corrugated steel panels in two tests. Geometric scaling laws were used to determine the fragment size and velocity and the size of the test barriers [Baker, W. E., Westine, P. S., Dodge, F. T., *Similarity Methods in Engineering Dynamics, Theory and Practice of Scale Modeling*, Southwest Research Institute, San Antonio, Tex., 1973] that corresponded to a one-half scale model of the full size fragment and barrier panel. In geometric, or replica scaling, all length and time parameters scale with the scale factor (i.e., by one-half) and all material properties are scale independent (i.e., the same in the full-scale model and the one-half scale replica). The fact that length and time parameters scale identically causes the velocity to also be scale independent.

A typical test barrier spanned 4 ft between supports. Most of the test barriers were 26 inches wide with 14 inch wide corrugated panels welded together to simulate typical welds that would be necessary in a full-scale barrier. The test barriers were bolted to a strong frame providing significant lateral tensile restraint to the test specimen. The corrugated steel panels were typical roof deck material with thicknesses ranging from 20 gage (0.036 inch thick) to nested double 16 gage panels (combined thickness of 0.12 inches). The fire resistant panels were either AFI or Durasteel panels. The 1 inch AFI panel (11 psf) had high strength concrete layers on each face ($f'_c$=8000 psi) with a low strength perlite inner core. The ⅜ inch thick Durasteel panels (4.3 psf) had thin gage steel plate on each face connected to a cement inner layer. The test barriers with single thickness sheets of corrugated steel panel were bolted to the test frame with A307 bolts and test barriers with double, nested sheets of corrugated steel panel were bolted with A325 bolts.

In all tests, the one-half scale test fragment was shot from the described gas gun at measured velocities within 2.5% of the desired velocity of 50 m/sec. The test barriers were observed after the tests to determine if there was fragment penetration through the panel, which was the test result of primary interest. The approximate dynamic deflections of the steel panels were measured with a pin gage, which consisted of five closely spaced steel wires of differing length set up behind the test barrier. Ideally, only the longer wires were deformed by the panel as it deflected so that the maximum deflection could be estimated based on the shortest deformed wire. This approach was an inexpensive method to measure the approximate maximum dynamic deflection, but it was not effective in some tests because all or none of the wires deformed. The maximum permanent deflection of the steel panels was also measured after each test.

Table 3 shows the preliminary test matrix and results. Fragment impact caused local stresses in the impact area and overall deflection of the test barriers between supports. The strength provided by the webs in the corrugated panels during first impact and the energy absorbed by the subsequent flattening of the corrugations helped prevent local perforation by the fragment. Tension membrane response of the corrugated steel panel, as well as the flexural and shear capacity of the panel, helped the test panels to stop the fragment without deflecting to the failure limit.

support as opposed to midspan, and with impact along the weld between attached panels.

It was evident that the standard 16 gage (0.06 inch) panel thickness was sufficient to stop the one-half scale fragment with a full 26 inch width and a stronger weld. The thickness and moment capacity of the 16 gage panel was scaled up to be nearly equivalent to those for a 10 gage (0.13 inch thick) steel bridge deck. Therefore, it was concluded that the bridge deck could be used with an 8 ft span to stop a full scale fragment.

TABLE 3

Test Matrix for One-Half Scale Preliminary Tests

| Panel No. | Fire Panel on Impact Side | No. Stacked Corrugated Steel Panels (note 1) | Panel Width (note 2) | Impact Location | Results |
|---|---|---|---|---|---|
| 101 | 1" AFI | 1 | 26" | Midspan along weld in steel panel | No fragment penetration of steel panel. Max. permanent deflection = 3.3". Small cracks steel panel at edges of welds near impact point. |
| 102 | 1"AFI w/26 g flat steel panel | 2 | 26" | Midspan along weld in steel panel | No fragment penetration of steel panel. Permanent deflection = 1.6" at impact point. Max. dynamic deflection at impact point = 2". |
| 103 | Durasteel w/1" AFI attached to back w/2 5/16" bolts | 1 | 14" | Midspan (no weld in steel panel) | No fragment penetration of steel panel. Back AM panel almost separated from steel panel by pulling through washer around on bolt. Some AFI chips 27" behind panel. Large permanent deflection = 4.1" at impact point. |
| 104 | 1" AFI | 1 | 26" | Edge (on crest of steel panel) | 3.5" clear from fragment impact area to edge of support. No fragment penetration of steel panel. Max. dynamic deflection between 3 and 4.5 inches (maxed out pins) at ¼ point on span. Permanent deflection at impact point = 4.9". |
| 105 | 1" AFI w/24 g flat steel panel | 1 | 26" | Edge (on valley of steel panel near bolt to frame) | 1.5" clear from fragment impact to edge of support. Steel panel torn at impact point (borderline penetration). Max. dynamic defl. < 3" at '/< span point. Permanent deflection at act point = 2.8". |
| 108 | 1" AFI | 1 | 26" | Midspan at crest on steel panel | No penetration of steel panel. Max dynamic deflection at impact point between 4 and 5.5 inches (maxed out pins). Permanent deflection = 4.8" at impact point. |
| 109 | Durasteel | 2 | 26" | Midspan at crest on steel panel | No penetration of steel panel. Max. dynamic deflection between 3 and 4.5 inches (maxed out pins) at impact point. Permanent deflection = 3.5" at impact point. |
| 110 | Durasteel both sides. Back had 2 5/16" bolts | 1 | 14" | Midspan (no weld in steel panel) | No penetration of steel panel. Durasteel panel on back had flexural crack almost through thickness. Both bolts held back panel on. Permanent deflection = 3.2" at impact point. |
| 111 | Durasteel | 1 | 26" | Edge at crest on steel panel | 3.5" clear from fragment impact to edge of support. No penetration of steel panel. Dynamic deflection equal to 3.5" at quarter point on span. |
| 112 | Durasteel | 1 | 26" | Edge at weld on steel panel | 1.5" clear from edge of fragment impact to edge of support. Total penetration by fragment. Permanent deflection = 2.3" at impact location. |
| 113 | Durasteel | One 18 gage panel 0.048" thick | 26" | Midspan at crest on steel panel | No penetration of steel panel. Permanent deflection = 6.0" at impact location. |
| 114 | Durasteel | One 20 gage panel 0.036" thick | 26" | Midspan along steel panel weld | Total penetration by fragment due to tears at welded connection of steel panel. Permanent deflection = 2.1". |

Note 1: All panels ASTM A653 steel, wide rib roof deck, 1.5 inch rib height, 6 inch rib spacing. All panels 16 gage (0.06 inches) unless otherwise noted.
Note 2: All panels wider than 14 inch are constructed with two 14 inch wide panels welded together with 3 inches of 1/16 inch weld every 6 inches along inside and outside of panel overlap Total or partial fragment penetration occurred during Tests 5, 12, and 14 (Panels 105, 112, 115). The test matrix was intended to cause some cases of fragment penetration so that the lower boundary of the required barrier strength could be estimated. Penetration tended to occur in test panels with the thinnest corrugated steel panel, with impact near the Final Tests The final test series consisted of six tests on two full-scale test barriers. In all cases a 30 kg cylinder with flat ends, fabricated from mild steel with a length to diameter ratio of 3:1 (4.6 inch diameter by 13.8 inch length), was shot at 50 m/sec (within 2%) into the test barriers. The test barriers consisted of corrugated steel bridge deck panels bolted to tube section ("TS") columns with fire resistant panels screwed to both sides of the panel. The steel panels were 8 feet long and 24 inches wide, overlapped to form an 8 ft. by ft. panel, with joints continuously welded on the impact side and stitch welded on the back (non-impact) side. The corrugated steel plate spanned 8 ft between column supports. The fire resistant panel on the non-impact side was intended to provide post-impact fire resistance in the area where the fragment sliced through the fire resistant panel on the impact side. Table 4 summarizes the construction of the two test barriers. The corrugated steel deck had 2 inch high ribs at 6 inch spacing. The ⅜ inch thick Armaplate fire resistant panel was of the same type as the Durasteel used in the preliminary tests. Armaplate is a composite material constructed from a sandwich of two 0.5 mm thick galvanised or stainless steel facing sheets mechanically fixed to a glass reinforced cement core; the facing sheets contain 6 mm square perforations at 17.5 mm centers, creating four triangular prongs to each square which are then embedded into the cement core under pressure, and is within a group of fire panels identified above as steel clad cement (SCC) panels. The 7/16 inch thick Titan™ panel was a fire-rated interior wallboard, with a fiber cement outer layer and a gypsum inner layer, weighing 2.8 psf, and is within the group identified above as fiber cement board (FCB) panels.

TABLE 4

Final Test Specimens

| Specimen No. | Corrugated Steel Plate | Fire Panel on Impact Side | Fire Panel on Non-Impact Side | Columns |
|---|---|---|---|---|
| 1 | 2" × 6" × 0.135" (10 gage bridge deck) | 7/16" Titan panel | 3/8" Armaplate | TS 8 × 4 × 0.25 |
| 2 | 2" × 6" × 0.179" (7 gage bridge deck) | 7/16" Titan panel | Double layer of 7/16" Titan panel | TS 8 × 4 × 0.25 |

The TS columns in the test barrier vertically spanned 9.5 ft between supports from the test frame. Spacer beams, with an 18-inch depth, were placed between the test barriers and the test frame so that the barriers could deflect without impacting the frame. Dynamic load cells were placed between the top and bottom of the right side column of the test barriers and the supporting test frame. The load cells measured the dynamic reactions applied by the barrier to the test frame. The approximate maximum dynamic deflections of the corrugated steel plate and the TS columns were measured with pin gages and crushable honeycombed aluminum material placed between the column at midspan and the test frame in some of the tests. The maximum permanent deflections of the steel panels and columns were also measured in all tests.

Table 5 shows the test matrix for the full-scale tests and lists the primary purpose for each test. The test purposes were similar to those for the preliminary tests. The test fragment was shot into the test barriers at midspan to cause maximum flexural stresses and near the supports on the corrugated steel panel to cause maximal shear stresses from the overall panel deflection, in addition to local stresses in the impact area. Also, the panel was impacted at the weld between adjacent steel panels and near one of the bolts at the supports. The latter impact point maximized the stresses on the bolt and steel panel material around the bolt. The column was also subjected to direct impact to verify that the fragment could not perforate the column. These tests also caused maximum dynamic reaction forces in the column. Information on the reactions from the barrier columns was important for specifying design of the column connections. Each test specimen was tested three times in different locations so that damage from preceding tests did not significantly affect the results of the subsequent tests. Any minor effect from a preceding test would be conservative since existing damage would tend to cause more severe test results.

TABLE 5

Test Matrix for Full Scale Tests of Fragment Barriers

| Test No. | Test Article | Impact Location of Fragment Centerline | Primary Test Purpose |
|---|---|---|---|
| 1 | 2 | At midheight on the corrugated panel (48" above bottom of panel) on crest beside valley with horizontal weld, near midspan between columns (51" from outside edge of right column). | Test for impact penetration through corrugated steel panel at horizontal weld midspan between supports. |
| 2 | 2 | At midheight on the corrugated panel on crest beside valley with horizontal weld, near support (3" from edge of angle). | Test for impact penetration through corrugated steel panel at horizontal weld near support. |
| 3 | 2 | Center of left column, 6 inches above top of "special" support at midheight on column used only for this test. | Test for penetration through column near column support (shear failure). |

TABLE 5-continued

Test Matrix for Full Scale Tests of Fragment Barriers

| Test No. | Test Article | Impact Location of Fragment Centerline | Primary Test Purpose |
|---|---|---|---|
| 4 | 1 | At midheight on the corrugated panel on crest beside valley with horizontal weld, near midspan between columns (51" from outside edge of right column). | Same as Test 1 except test article has thinner corrugated steel panel. |
| 5 | 1 | Near midheight on the corrugated panel (66 inches above bottom of column) in panel valley with bolt (3 inches from edge of angle). | Same as Test 2 except test article has thinner corrugated steel panel. Also, impact is at a valley right beside a bolt. |
| 6 | 1 | Center of right column, 62.5 inches above bottom of column. | Test for impact penetration through column at midspan (flexural failure). |

Table 6 shows results from the final test series. No perforation of the test barriers occurred in any of the tests. The maximum dynamic deflections of the barrier were only measured with a high level of confidence for the columns. The pin gages measurements behind the barrier panels in Tests 1 and 4 were most probably affected by the damage to the fire panels on the backside of the barrier, as indicated in Table 6.

In Table 6, the following notes apply: Note 1: Maximum load measured with dynamic load cells at top and bottom supports for right column of test articles. Note 2: "dyn" is maximum dynamic deflection, "perm" is permanent deflection, "local" is permanent local deflection at impact point on front face of column. Column deflections are at midheight of column closest to impact, except local deflection is at impact point. Panel deflections are at impact point.

TABLE 6

Summary of Test Results From Full Scale Tests of Fragment Barriers

| Test No. | Fragment Velocity (m/sec) | Peak Load[1] Top of Col. (lbs) | Peak Load[1] Bot. of Col. (lbs) | Panel Deflection[2] (in) | Column Deflection[2] (in) | Comments |
|---|---|---|---|---|---|---|
| 1 | 48.0 | 14,000 @370 ms | 11,000 @ 370 ms | 6.3 (perm) | <0.75 (dyn)<br>t 0 (perm) | No perforation of panel. Panel deflection gage most probably impacted by spalled pieces off back Titan panel. Spalled pieces traveled at least 10 ft to backstop. No visible damage to weld at impact point. Crest on panel at impact point was pushed through the valleys on either side. Most of permanent deflection within the crest and both adjacent valleys. |
| 2 | 48.1 | 24,800 @ 40 ms | 19,600 @ 36 ms | 5.5 (perm) | t 0.5 (dyn)<br>t 0 (perm) | No perforation of panel. Spalled area of back Titan panel. No visible damage to weld at impact point. Angle near impact was permanently deflected about 1 inch at free edge. Crest on panel at impact point was pushed through the valleys on either side. No visible damage to bolts near impact. |
| 3 | 50.8 | N/A | N/A | N/A | 0.9 (local) | No perforation of column. Flange separated from web with angle along 5 inch tear at impact point. Most of permanent deflection occurred within 6 inch length. The angle stiffened the adjacent web relative to web on either side of column, causing fragment to rotate during impact. |
| 4 | 48.3 | 13,600 @ 48 ms | 9,800@ 48 ms | >7 (dyn)[3]<br>7.5 (perm) measured after Test 6 | 0.38 (dyn)<br>t 0 (perm) | No perforation of panel. Nails from Armaplate panel on back were thrown at least 10 ft to backstop. Steel layer separated from concrete core and crack in Armaplate panel at impact area. No visible damage to panel weld at impact point. Panel crest in impact area pushed through the valleys on either side. Most of permanent deflection within the crest and both adjacent valleys. |
| 5 | 49.3 | 29,600 @ 39 ms | 19,900@ 43 ms | 7.0 (perm) | t 1.2 (dyn)<br>t 0 (perm) | No perforation of panel. Bolt hole (15/16 inch) beside impact elongated to about 1.7 inches. Tear panel (0.5 inch long) at bolt hole perpendicular to hole elongation. Crests on either side of impact point were partially flattened. Local damage to back Annaplate panel at impact point. Column dynamic deflection estimated assuming deflection gage holder did not impact column. |
| 6 | 48.0 | 55,500 @ 38 ms | 55,900@ 39 ms | N/A | 2.2 (dyn)<br>0.2 (local)<br>1.8 (perm) | No perforation of column. Large rebound of fragment (approx. 10 ft). Test FIG. moved approx. 4 inches on impact side. Movement occurred at late time compared to column response |

Note 3: Pin in pin gage may have been directly behind large crack in back Armaplate panel so that actual panel deflection was more than 7 inches.

Regarding the fire panels, the test fragment sliced a hole through the front fire panels, which caused some subsequent cracking of the brittle Titan panel. Impact near midspan of the corrugated steel panels created a large deflection of the steel panel which caused significant damage to the back Titan panel and Armaplate fire panels that would prevent them from resisting an intense post-impact fire hazard. The back fire panel damage deformed all the pins in the pin gages used to measure the dynamic panel deflection, so that they did not measure the dynamic deflection of the steel panel.

Figure 7:
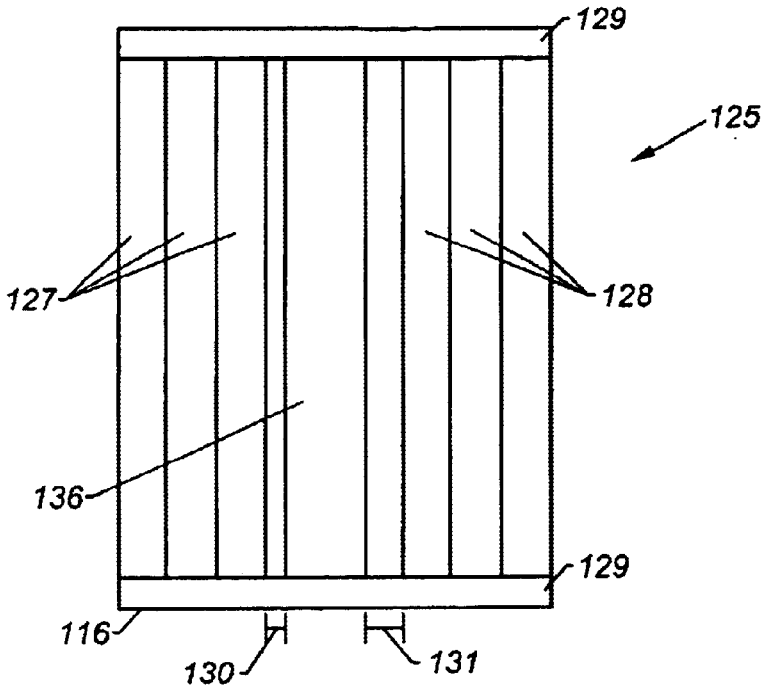
FIG. 7 is a diagrammatic illustration of a top plan view of a safety barrier with blast side and non-blast side oxygen fire resistant panels.
Figure 8:
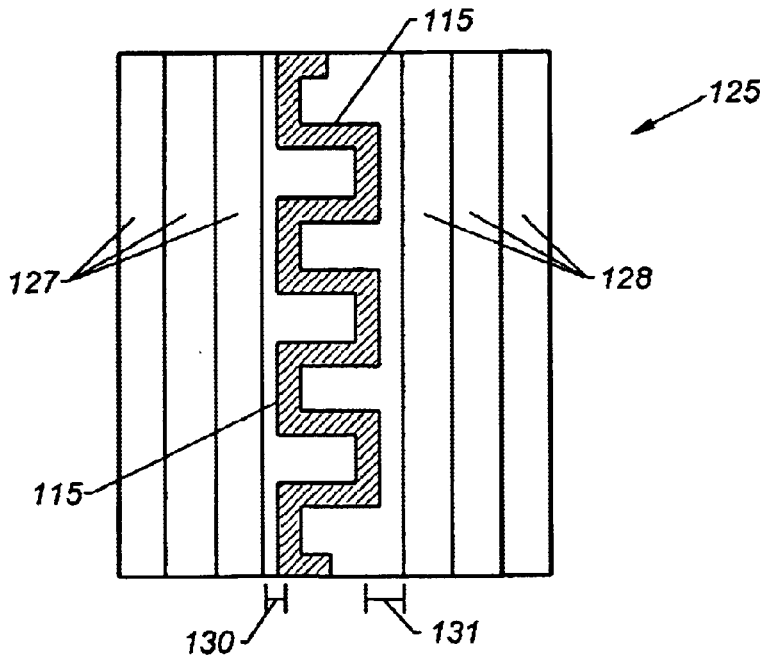
FIG. 8 is a diagrammatic illustration of a top plan view of a fragment barrier with blast side and non-blast side oxygen fire resistant panels.
Figure 9:
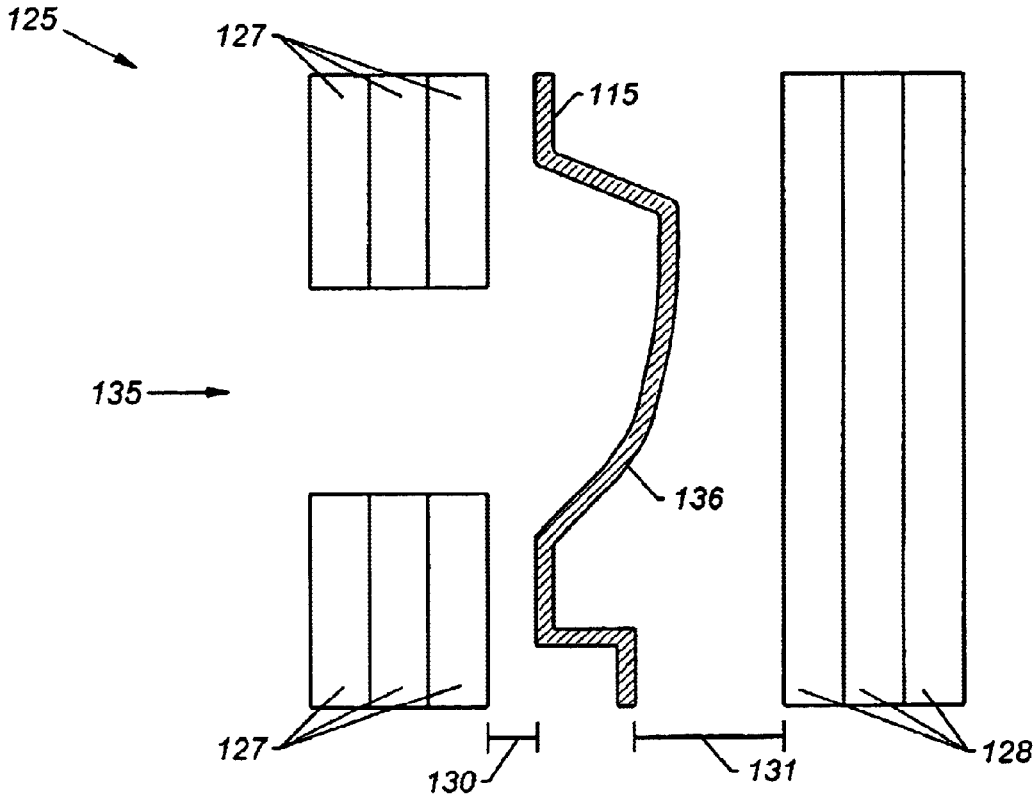
FIG. 9 is diagrammatic illustration of a top plan view of a fragment barrier with blast side and non-blast side oxygen fire resistant panels after testing with a blast fragment.

These tests demonstrated that the fire resistant panel on the non-blast side of the safety panel must be spaced from the impact panel 117 a distance in excess of the maximum allowable deflection of said impact panel. Referring to FIGS. 7, 8 and 9, an embodiment of the present invention incorporating this discovery is diagrammatically illustrated. Referring to FIGS. 7, 8 and 9, safety barrier 125 comprises a panel membrane 115, a plurality of fire resistant panels 127, and plurality of fire retardant panels 128. FIG. Panels 127, 115, and 128 are connected by supports 129 and 136. Support 129 may be connected across all three panels or there may be three separate supports for each of systems 127, 115, and 128. In an embodiment, support(s) 129 extend along a side of panels 127, 115, and 128. In another embodiment, a separate support exists behind each support layer. In other embodiments, panel 127 and/or 128 is adjacent and connected to membrane panel 115, such that membrane panel system 115 provides support for system 127 and/or 128. Support 136 connects supports 129.

Panels 127 and/or 128 are constructed of fire barrier material. The fire barrier material suitably is selected from a group consisting of steel clad cement panels and fiber cement panels (see Table 1 above). In an embodiment, as shown in FIGS. 7, 8 and 9, panel 127 comprises three layers of fire barrier material. In an embodiment, as shown in FIGS. 7, 8 and 9, panel 128 comprises three layers of fire barrier material. However, any number of fire barrier layers may be used. The thickness of the fire barrier material may be any desired thickness, taking into consideration design and test considerations as heretofore described. Reference numerals 130 and 131 indicate that the fire resistant panel layers 128 on the non-blast side of the fragment barrier panel membrane 115 are spaced more distant from impact panel 115 than the fire resistant panel layers 127 on the blast side of the fragment barrier panel membrane 115. Since tests showed that the fire resistant panel layers 127 on the blast side of the fragment barrier panel membrane 115 are will be sliced through by a fragment passing as depicted by reference numeral 135 in FIG. 9, the spacing on that side of the fragment barrier 115 is not critical. However spacing of the fire resistant panel layers 128 on the non-blast side of the fragment barrier panel membrane 115 is in excess of the maximum allowable deflection 136 of said impact panel. In the instance of the tested barriers, a distance of at least 8 inches is preferred.

Regarding the welds, testing as described showed impact near midspan to the corrugated steel panel and impact near the support, very near the horizontal continuous welds on the outside of the overlap between adjacent steel panels, showed the welds performed very well.

The only failure of any sort in the steel panel occurred during Test 5, where approximately 1 inch of panel tearing occurred around a bolt hole due to fragment impact very near the bolt. Fragment impact near a bolt limited the volume of steel panel that had to absorb the energy from fragment impact, which caused higher localized strains in the panel.

In Test 3, the barrier column was damaged after direct fragment impact. The flange separated from one of the webs of the tube section over a 5 in length as the flange went into tension between the webs.

The worst damage to the column and steel panel of the test barriers occurred during Tests 3 and 5, respectively, as described. Neither case was considered to be near borderline fragment penetration. Therefore, both barriers resisted the effects of the test fragment impact with some factor of safety. Test Specimen 1, with the thicker steel panel, provided a greater factor of safety than Test Specimen 2.

The measured column reaction forces showed that large reaction forces can occur, especially when the fragment directly impacted the column (i.e., Test 6). The time to the peak column reaction force was typically about 40 ms after time zero, which corresponded to fragment launch time from the end of the gas gun, and the duration of the positive phase reaction force (i.e., in the direction of fragment impact) was typically about 15 ms. The time to peak column reaction force was 370 ms in Test 1 because time zero for this test was the initial application of gas pressure on the fragment before it traveled the length of the gas gun barrel. The maximum reaction forces were greater at the top of the test barrier columns than at the bottom in all tests where the fragment impacted the panel, whereas theoretically they should have been nearly equal. However, nearly identical peak reaction forces were measured in Test 6, which is the only test where direct fragment impact on the column occurred. The load cells were purchased new for this project and were calibrated by the manufacturer. Therefore, the panel evidently did not distribute the load into the columns uniformly along the column height. No column reactions were measured during Test 3 due to limitations of the test setup.

Test 6, with direct fragment impact on the column, caused a much higher peak reaction force than Test 5, where the fragment impacted the panel very near the column. However, the lower column load cell impulses from the two tests were nearly equal. This implies that the same energy was applied to the column, but the column responded in a higher mode to the direct fragment impact in Test 6. The anchor bolts or connections on columns of a barrier installed in the field should be stiff enough to respond to the higher peak reaction force from Test 6, even though it has a very short duration.

Dynamic Response of the Barrier to Fragment Impact

The barrier response includes local response to fragment impact and overall response of the whole barrier between its supports.

Local response of the barrier, which is a complex phenomena, includes the strengthening and stiffening effects of the corrugations in the steel panel during initial impact and the subsequent flattening of the corrugations in the local impact area. Only the corrugated steel panel and columns are assumed to have significant strength, and the fire resistant panels are only assumed to add mass. The understanding of local impact was limited to an empirical understanding that the 10 gage thick panel in Test Specimen 1 and the TS 8×4×0.25 columns were sufficient to prevent local penetration by the test fragment with at least some factor of safety. The columns did not have any significant damage to the webs or back flange. The panel will resist impact by the specified fragment near the supports without failing. Impact near the supports maximizes local shear and tension stresses in the panel because it limits the volume of panel material that absorbs most of the energy applied by fragment impact.

The overall response of the corrugated steel panel and columns to fragment impact near midspan can be calculated by setting the kinetic energy imparted into the barrier components by fragment impact equal to the strain energy absorbed by the barrier components at their maximum deflection in the first mode shape [Baker, W. E., Cox, P. A., Westine, P. S., Kulesz, J. J., and Strehlow, R. A., *Explosion Hazards and Evaluation*, Elsevier Scientific Publishing Company, New York, N.Y., 1983].

The kinetic energy imparted into the panel can be calculated assuming conservation of momentum during plastic impact between the fragment and the panel (i.e, the fragment moves with the panel after impact). An effective panel mass is used in the conservation of momentum equations, based on an average of the elastic and plastic shape functions for a beam with a concentrated midspan load [Biggs, J. D., *Introduction to Structural Dynamics*, McGraw-Hill Publishing Company, New York, N.Y., 1964 (hereinafter "Biggs, 1964")]. This causes approximately 33% of the component mass, including attached fire panels, to be "effective" since the entire mass of the panel does not move through the whole maximum deflection.

The kinetic energy of the corrugated panel and fragment after plastic impact by the fragment can be calculated using Equation 1.

$$KE = \frac{0.5\, m_f^2 v_f^2}{g(m_f^2 + k_m m_p)} \qquad \text{Equation 1}$$

where

KE=kinetic energy of panel and fragment after impact, $m_f$=weight of fragment, $v_f$=impact velocity of fragment, $m_p$=weight of 18 inch width of panel, including all attached connector parts that move with the panel, g=gravity constant, $k_m$=effective mass factor for panel (a value of 0.33 is preferred based on an assumed deformed shape of panel with a concentrated load at midspan during plastic response).

The calculated kinetic energy of the corrugated steel panel in Test 4 immediately after fragment impact was 180 kip-inch The strain energy is equal to the area under the graph of resisting force vs. midspan deflection for the barrier components. This graph can be based on handbook equations for the relationship between a static concentrated midspan load and midspan deflection of a beam with, and without, laterally fixed supports for the panel and column, respectively [Roark, R. J. and Young, W. C., *Formulas for Stress and Strain*, McGraw-Hill Book Co., NY, N.Y., 5th ed., 1975]. The panel spans one-way between supports that are prevented from moving laterally by the compression stiffness of the other panels in the barrier above and below the impact point. The resisting force of the beam is equal to the load (in the handbook equation) since this is required by static equilibrium. The load, or resisting force, is a function of the bending moment and tensile membrane force in the beam.

The yield strength can be increased by a dynamic increase factor for the material yield strength to account for the higher observed steel strength during high strain rate response typical during blast and dynamic impact loading and by an increase factor that accounts for typical ratios of between actual and minimum specified yield strengths [ASCE Task Committee on Blast Resistant Design, *Design of Blast Resistant Buildings in Petrochemical Facilities*," American Society of Civil Engineers, New York, N.Y., 1997 (hereinafter "ASCE 1977")]. Equation 2 and Table 1 show information for calculating the enhanced dynamic material strengths for the structural steel components of the barrier. The average strength factors, a, in Equation 2 account for the average ratio of the actual strength of materials to the minimum specified strength. The dynamic increase factors, c, in Equation 2 account for the measured strength enhancement in material yield strength during high strain-rate response representative of that caused by large fragment impact.

$$f_{dy}=f_y(a_y)(c_y)$$

$$f_{d\mu}=f_\mu(a_\mu)(c_\mu) \qquad \text{Equation 2}$$

where $f_{dy}$=dynamic design yield strength $f_{d\mu}$=dynamic design ultimate strength $f_y$=minimum static yield strength $f_\mu$=minimum static ultimate strength $c_y$=dynamic increase factor for dynamic yield strength a=average strength increase factor for yield strength $c_\mu$=dynamic increase factor for dynamic ultimate yield strength $a_\mu$=average strength increase factor for ultimate strength Recommended values for the dynamic increase factor, c, and the average strength increase factor, a, are shown in Table 7 for different types of steel components used for barrier construction. The values for "a" and "c" are based on information in ASCE 1997.

TABLE 7

Dynamic Material Strength Increase Factors for Hot Rolled Steel Components

| | Yield Strength | | Ultimate Strength | |
|---|---|---|---|---|
| Minimum Static Yield Strength (psi) | Average Strength Increase Factor ($a_y$) | Dynamic Increase Factor ($c_y$) | Average Strength Increase Factor ($a_u$) | Dynamic Increase Factor ($c_u$) |
| 30,000–40,000 | 1.1 | 1.29 | 1.0 | 1.1 |
| 40,000–60,000 | 1.1 | 1.19 | 1.0 | 1.05 |

In all cases, connections can be designed based on their ultimate capacity without a factor of safety. No factor of safety is required since the peak dynamic reaction loads specified for design are considered to be upper bound values. Also, the peak dynamic loads have a very short duration as shown by reaction force histories measured during full-scale tests.

An interaction equation [AISC, *Manual of Steel Construction, Load and Resistance Factor Design*, American Institute of Steel Construction, Inc., Chicago, Ill., 2 vols., 2nd ed., 1995 (hereinafter AISC 1995")] must be used to reduce the bending moment based on the tensile membrane force, since stress from the tensile force limits the bending moment that can be developed in the panel. Also, the tensile membrane force in the panel is limited by the lesser of the tensile capacity of the cross section or the maximum strength of the connections considering the bolt shear capacity and the tearing and bearing capacity of the panel material around the bolts [AISC 1995]. The panel bears on the column supports so the whole shear capacity of the bolts can be considered effective at developing tension in the panel.

Figure 10:
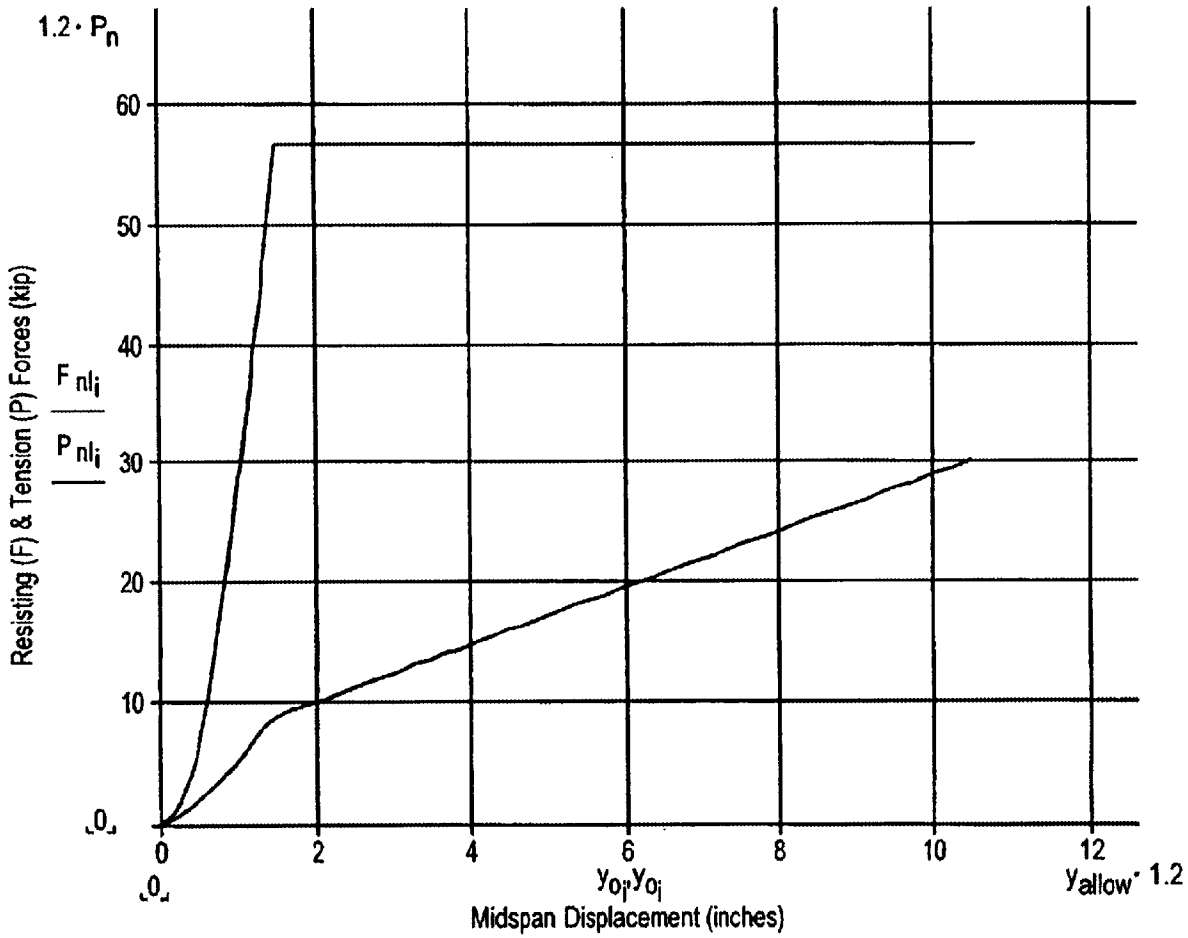
FIG. 10 is a graph calculated resisting force (F) and tensile force (P) vs. midspan deflection of a test panel.

FIG. 10 shows the calculated resisting force (F) and tensile force (P) expressed in "kips" (kilopounds, i.e., 1000 pounds) in a 18 inch width of the 10 gage panel in Test Specimen 1 vs. midspan deflection. The resisting force due to combined tension membrane and flexural resistance reaches a value of 30 kips at a midspan deflection of 10.5 inches. The strain energy at this deflection, equal to the area under the resisting force vs. deflection curve in FIG. 10, is 180 kip-inch. FIG. 10 also shows that the tensile force peaks at 57 kips based on the calculated ultimate capacity of the connections, which is assumed to hold the maximum capacity in a ductile manner out to a failure deflection of the panel. This capacity is controlled by local yielding of the panel in bearing around the bolts, which was observed in the full-scale tests. The resisting force increases linearly with midspan deflection when the tension membrane force is constant.

Figure 11:
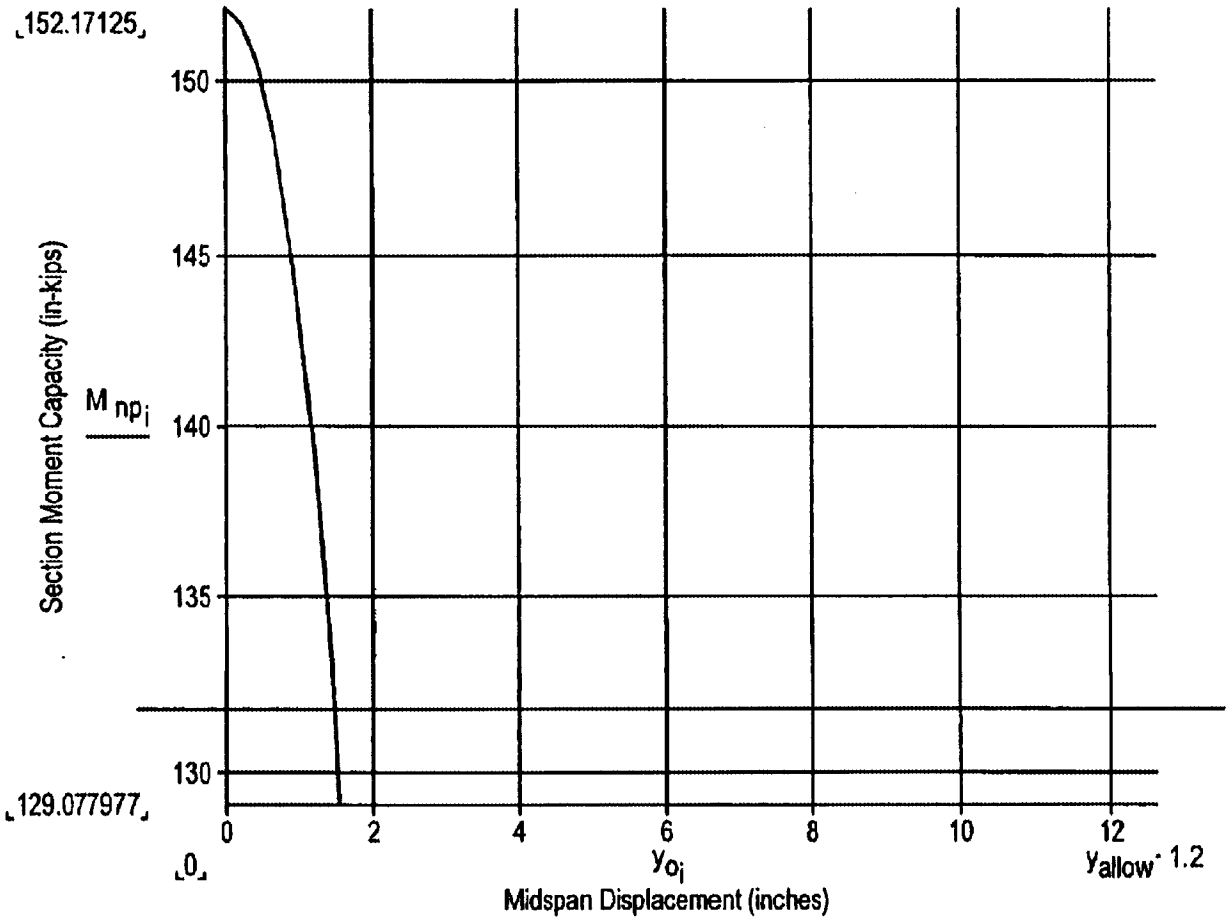
FIG. 11 is a graph of sectional moment capacity vs. midspan deflection (displacement) in a test panel.

FIG. 11 shows how the available moment capacity in an 18 inch width of panel decreases to 129 kip-in with midspan deflection from the full dynamic moment capacity of 152 kip-inch The available moment capacity decreases with the panel deflection because deflection causes tension membrane response and the interaction equation reduces the available moment capacity based on the tensile membrane stresses. At a deflection of 1.2 inches, the tensile membrane force becomes constant at the maximum value of 57 kips and therefore there is no subsequent decrease in the available moment capacity. The available moment capacity is assumed to remain effective past flexural yielding in a ductile manner out to a failure deflection of the panel.

As stated previously, the strain energy in the panel at a deflection of 10.5 inches was equal to the calculated kinetic energy of 180 kip-inch imparted by fragment impact. Therefore, the maximum dynamic deflection of the panel calculated based on conservation of energy is 10.5 inches. This value assumes an 18 inch width of the panel develops strain energy and moves with the fragment through the maximum deflection of 10.5 inches. Actually, a width less than 18 inches moves the full deflection, while a width greater than 18 inch undergoes at least some amount of deflection. The 18 inch dimension causes a relatively good match between predicted displacement and measured values, as discussed in the next paragraph. The tension membrane is based on restraining force from bolts over a 2 ft width, equal to the panel width. A wider area of panel can provide tension restraint compared to the equivalent width that moves through the maximum deflection.

Table 8 shows a comparison of measured and calculated maximum dynamic deflection of the corrugated steel panel during Tests 1 and 4, where fragment impact occurred at midspan on the panel. Only the maximum permanent deflection was measured with a high level of confidence during the tests due to failure of the back fire panel, so the total maximum deflection was estimated assuming the panel rebounded elasticly from the maximum deflection. The maximum "measured" dynamic deflections in Table 8 are equal to the calculated maximum elastic deflection at flexural yielding of the panel plus the measured permanent deflection. The maximum calculated deflections in Table 8 were calculated as explained in the previous paragraphs with an assumed 18-inch effective width. The comparisons in Table 8 show that the calculated deflections compare well with measured values. The panel response in Tests 2 and 5, where impact was near the edge of the panel, was dominated by local response and, therefore, could not be calculated with a simple calculation procedure.

TABLE 8

Comparison of Measured and Calculated Deflections of Corrugated Steel Panels from Midspan Impact on Panels

| Test No. | Measured Permanent Deflection (in) | Calculated Yield Deflection (in) | Assumed Maximum Measured Dynamic Deflection (in) | Calculated/ Measured Maximum Dynamic Deflection (in/in) |
|---|---|---|---|---|
| 1 | 6.3 | 1.9 | 8.2 | 8.5/8.2 = 1.04 |
| 4 | 7.5 | 1.9 | 9.4 | 10.5/9.4 = 1.12 |

The overall response of the column to direct fragment impact near midspan can be modeled in the same manner as panel response except that the supports are assumed to move laterally, precluding tension membrane response. A 24 inch effective panel width (one-quarter of the panel span) is assumed to move with the column, adding mass but no strength. The strength and stiffness of the angle connecting the panel to the column are assumed to add to the column strength and stiffness. The case of fragment impact on the edge of the panel near the column can be treated identically to direct fragment impact on the column, since almost all the reaction load from the panel is transferred into the nearby column. A higher effective mass factor of 0.41 is preferred for the column and attached panel mass because the column maximum deflection is limited to a smaller value than that of the panel and more deflection takes place in the elastic realm, where a higher mass factor applied.

Table 9 shows a comparison between measured and calculated maximum deflections and maximum reaction forces for the test barrier columns. The comparison between calculated and measured maximum dynamic deflections shows that the maximum dynamic column deflection calculated with the energy equivalency procedure compares well with the deflection caused by direct fragment impact in Test 6. However, this method significantly overestimates the measured column deflections from impact on the panel near midspan of the column in Tests 2 and 5. Evidently significant energy is dissipated in the panel impact. Therefore, assuming that impact on the panel next to the column is equivalent to direct impact on the column is a simplifying, conservative approach to calculate column deflection.

TABLE 9

Comparison of Measured and Calculated Column Response Parameters For Impact On or Near Column at Midspan

| Test No. | Measured Max. Dynamic Deflection (in) | Calculated/ Measured Maximum Dynamic Deflection (in/in) | Calculated/ Measured Maximum Reaction [1] (kip/kip) | Comments |
|---|---|---|---|---|
| 2 | 0.5 [2] | 2.2/0.5 = 4.4 | 27/22 = 1.23 | Impact on edge of panel assumed equivalent to direct impact on column. |
| 5 | 1.2 [2] | 2.4/1.2 = 2.0 | 28/25 = 1.1 | Impact on edge of panel assumed equivalent to direct impact on column. |
| 6 | 2.2 | 2.4/2.2 = 1.1 | 28/60 = 0.45 | Direct impact on colunm |

Note 1: Measured max. column reaction is average of max. reactions from top and bottom support point load cells.
Note 2: Estimated max. column dynamic deflection.

The column reaction forces in Table 9 were calculated using Equation 3 for the dynamic reaction of a beam responding in the first mode flexural bending shape from Biggs (1964). The maximum resisting force is known from the calculations required to determine the strain energy absorbed by the column. Conservatively, the applied force due to fragment impact can be assumed to have a very short duration so that most of the dynamic reaction force (V) is dominated by the column resisting force (R) and the maximum reaction force is equal to 78% of the maximum resisting force. The comparisons between measured and calculated peak reaction forces in the table show that this is a reasonable assumption for the two cases (Tests 2 and 5) where there is not direct fragment impact on the column.

$$V(t)=0.78R(t)-0.28F(t) \qquad \text{Equation 3}$$

where:

V(t)=dynamic reaction as function of time (t)

R(t)=component resisting force as function of time (t)

F(t)=applied force as function of time (t)

For the case where there is direct impact on the column, the peak reaction is much greater than that predicted by Equation 3. This indicates that the maximum reaction force is caused by column response in a higher mode shape. Probably, the panel initially responds as a rigid member in shear and transmits most of the peak force applied by the fragment during impact directly to the reactions. Later in time, the midspan area of the column deflects relative to the supports and first mode flexural response dominates. This is indicated by the good match between the calculated and measured maximum dynamic column deflections in Table 9.

The comparisons between measured and calculated values in Table 8 and Table 9 show that much of the observed response of the corrugated steel panel and barrier columns can be modeled with simple methods for the case of fragment impact at midspan. However, the peak column reaction force cannot be predicted well with the simple theoretical relationship in Equation 3 that is only applicable for dynamic response in a simple flexural bending mode. The equation gives a reasonable upper bound for cases where the fragment impacts the panel near the column causing a more gradual load on the column that does not excite higher response modes dominated by shear. Also, there is no available simple method for calculating whether local penetration of the panel and column occurs. The fact that all the response modes of the column and corrugated steel panel important for design cannot be modeled well with simple design-oriented methods means that barrier design must be based, in part, on replicating the full-scale test barriers that successfully stopped the test fragment.

Barrier Design Methodology

The objective is a barrier that will resist impact by a fragment similar to the full-scale test fragment without perforating and without any failure of structural components. The barrier must also resist an equivalent static load from venting high pressure gas. Local response of the barrier is a complex phenomena that cannot be modeled with any available simple design-oriented methodologies. Therefore, the design of barriers for local response is based on the full-scale test specimens that successfully resisted fragment perforation. A minimum corrugated steel plate thickness of 10 gage (0.135 inches) is required to prevent local fragment perforation based on the thinnest full-scale test panel, with a minimum panel rib height of 2 inches and a maximum panel rib spacing of 6 inches. The panel steel must also have a yield strength of 50,000 psi to 60,000 psi. The test panels had a yield strength of 50,000 psi and a maximum value is given since higher yield strengths are typically achieved by sacrificing ductility, which may be counterproductive for the panel performance. This type of panel will also resist local penetration stresses and shear stresses caused by impact near the column support from a fragment similar to the full-scale test fragment.

The barrier column and corrugated steel panel should also be designed to resist fragment impact at midspan without deflecting so far that overall failure of the barrier components can occur. Typically, the maximum flexural response of steel components to blast or impact load is limited by a maximum allowable ductility ratio and a maximum deflection to span ratio. As shown in Equation 4, the ductility ratio is based on the maximum dynamic deflection of the structural component. The yield deflection, $y_{el}$, is equal to the maximum dynamic flexural capacity of the component divided by the flexural stiffness. The maximum dynamic deflection of the panel and column can be calculated based on conservation of energy between the kinetic energy of the barrier component imparted by fragment impact and strain energy absorbed by the component at maximum deflection, as explained above.

$$\mu = \frac{y_m}{y_{el}} \quad \text{Equation 4}$$

where $\mu$=ductility ratio $y_m$=maximum dynamic component deflection $y_{el}$=deflection causing yielding in component at all maximum moment regions.

Table 10 shows recommended criteria for design of barriers against midspan fragment impact and blast load from the American Society of Civil Engineers (ASCE) for medium or moderate component response [ASCE, *Structural Design for Physical Security*, American Society of Civil Engineers, New York, N.Y., 1999 (hereinafter "ASCE 1999")][ASCE 1997]. Medium or moderate response is approximately one-half that of severe, or high response where the component is near failure.

TABLE 10

Design Criteria for Maximum Deflection of Barrier Components

| Component | Maximum Ductility Ratio [1] | Maximum Deflection to Span Ratio [1] |
|---|---|---|
| Corrugated Steel | 10 | 12% |
| Panel Column | 10(3) [2] | 5.5%(1.7%) [2] |

Note 1: The more stringent of the ductility or the span to deflection criteria controls the maximum allowable deflection.
Note 2: Use reduced criteria in parentheses if column axial load exceeds 2% of the axial capacity.

The more stringent of the ductility or the span to deflection criteria in Table 10 controls the maximum allowable deflection. A larger deflection to span ratio is shown for the corrugated steel panel than for the column since the panel responds in both tension membrane and flexural response, whereas the column only responds in flexural response. The 12% value is taken from ASCE 1999 for steel beam-type components with combined flexural and tension membrane response. The 5.5% value is taken from ASCE 1997 for steel beam components, which does not require tension membrane response. The deflection-to-span ratio in Table 10 for columns with axial load are for design of members of one or two story moment resisting frames, from Departments of the Army, the Navy and the Air Force, *Structures to Resist the Effects of Accidental Explosions*, Department of the Army Technical Manual TM 5-1300, Department of the Navy Publication NAVFAC P-397, Department of the Air Force Manual AFM 88-22, November 1990 (hereinafter "TM-5-1300"). No ductility value is given in TM 5-1300. The ductility value of 3.0 in Table 10 is based on information in Stea, W., Tseng, G., and Kossover, D., *Nonlinear Analysis of Frame Structures Subjected to Blast Overpressures*, US Army Armament Research and Development Command, Report ARLCD-CR-77008, May, 1977, for dynamic design of frame members. The barrier columns should not be used to support any significant amount of axial load. The criteria in Table 10 have approximately a safety factor of two against failure due to overall component response to impact and blast load. Therefore, no safety factor is required on the material strengths in the design approach.

Practical limits to maximum barrier deflection, such as the distance between the barrier and protected personnel, should also be considered in a designing a barrier. This type of deflection criteria may control the barrier design compared to those shown in Table 10, which are only intended to prevent structural failure. In addition, more severe fragments are possible from failed oxygen handling equipment than the 30 kg cylinder used in the full-scale tests. There is some safety factor in the design criteria as evidenced by the test results, which did not include any cases where the barrier was near failing. However, an additional safety factor can be provided by using thicker corrugated steel plate.

The corrugated steel panel connections to the column must be designed to cause enough tension membrane response for the panel to resist midspan fragment impact according to the design criteria in Table 10. The connections must also be sufficient to prevent panel failure if the fragment impacts near the panel connection to the column. Since the ⅞ inch diameter A490 bolts at 12 inches on center were adequate for the two full-scale tests with fragment impact near the supports, this connection is adequate as a conservative minimum in the barrier design methodology. The maximum reaction forces for the column were measured during Test 6, where the fragment impacted the column at midspan. Peak reaction forces of 56 kips was measured at the top and bottom supports for a total of 112 kips, although the top support reaction force was clipped off in the measurement. Direct fragment impact on the column near a support, rather than at midspan, will cause higher reaction forces than those measured in Test 6. The total measured reaction load from both supports from Test 6, rounded up to 130 kips with a small increase factor (15%), can be considered as an estimate for the reaction force from impact near a column support. Also, the shear capacity of the column is an upper bound, which is shown in Equation 5 from TM 5-1300. Therefore, the maximum dynamic connection force on the column connection is the lesser of 130 kips or the $V_{cap}$ in Equation 5. In all cases, the connection can be designed based on the ultimate connection capacity without a factor or safety since the peak measured dynamic reaction loads have very short durations and the column shear capacity is an upper bound load.

$$V_{cap}=0.55\, f_{dy}A_v \quad \text{Equation 5}$$

where $V_{cap}$=dynamic shear capacity of column $f_{dy}$=dynamic yield strength of column steel, and $A_v$=web area of column and said attached connectors resisting shear at the support.

The barrier can also be subjected to a post-impact pressure load from gas jetting out of the failed compressor piping. It is estimated that the rise time of the of the gas jetting load to peak pressure is at least 100 ms. The post-impact gas pressure load can be treated as an equivalent static load, where the load is increased by a dynamic load factor to account for the larger stresses caused by the sudden application of the load. For the case of a dynamic load with a linearly increasing rise time and a very long duration, the dynamic load factor can be taken as 1.1 for ratios of the pressure rise time to component natural period greater than 2.0 [Biggs, 1964]. The dynamic load factor can be reduced to 1.05 when this ratio is greater than 5.0. These dynamic load factors and basic structural design parameters can be used to calculate the post-impact gas pressure load that a barrier can resist, as shown in Table 11.

TABLE 11

Approximate Static Load Capacity Information for Post-Impact Gas Load.

| Barrier Component | Span Length (ft) | Natural Period (ms) | Dynamic Load Factor [1] | Gas Pressure Capacity (psi) |
|---|---|---|---|---|
| 10 gage bridge deck w/ fire panel on both sides | 8 | 48 | 1.1 | 4.6 [2] |
| 7 gage bridge deck w/ fire panel on both sides | 8 | 40 | 1.1 | 6.0 [2] |
| 8 × 4 × 0.25 TS column w/ 4 ft loaded width | 9.5 | 25 | 1.1 | 7.0 |

Note 1: For assumed pressure rise time of 100 ms.
Note 2: 1 ft out of 10 ft wide deck is assumed to have no capacity due to fragment impact damage.

The following summarizes the equations and certain considerations for the calculations used in the methodology of this invention.

1. Dynamic Strength Properties

The high strain-rates that occur during rapid structural response cause measurable increases in the yield and ultimate strengths of many materials, including steel. Equation 1 set forth above and Table 1 show information for calculating the enhanced dynamic material strengths for the structural steel components of the barrier. Recommended values for the dynamic increase factor, c, and the average strength increase factor, a, are shown in Table 7 for different types of steel components used for barrier construction. In all cases, connections can be designed based on their ultimate capacity without a factor of safety. No factor of safety is required since the peak dynamic reaction loads specified for design are considered to be upper bound values. Also, the peak dynamic loads have a very short duration as shown by reaction force histories measured during full-scale tests. Only concrete anchor bolts recommended for dynamic design should be used and the anchor bolt embedment depth should be maximized to engage more concrete during high magnitude, short duration dynamic reaction loading. A minimum embedment depth of 5 inches is preferred.

2. Corrugated Steel Panel Design

The barrier should be constructed with a corrugated steel panel having a minimum size of 2"×6"×10 gage thick. That is, the panel must have a minimum required thickness of 10 gage (0.135 inches), a minimum rib height of 2 inches, and a maximum rib spacing of 6 inches. The panel steel must also have a yield strength of 50,000 psi to 60,000 psi. A heavier panel that may have deeper ribs (i.e. more than 2 inches deep) should be used when possible to help provide a greater factor of safety against penetration by a fragment, since the fragment shape, size, and velocity cannot be known for all possible accident scenarios.

The energy from local impact is transferred into the panel through flattening of the corrugated ribs and local deformation of the panel, as well as heat generation. The previously mentioned minimum panel size is sufficient to prevent local penetration based on the full-scale test results described above in connection with Table 6. The full scale test results show that the minimum specified panel will resist impact by the specified fragment near the supports without failing. Impact near the supports maximizes local shear and tension stresses in the panel because it limits the volume of panel material that absorbs most of the energy applied by fragment impact.

The panel must also absorb the energy applied by fragment impact near midspan acting as a one-way beam between supports without exceeding maximum allowable deflection criteria specified in Table 10. The overall response of the panel is acceptable if the strain energy dissipated at the maximum allowable deflection is equal to, or greater than the kinetic energy imparted into the panel by fragment impact. The kinetic energy of the corrugated panel and fragment after plastic impact by the fragment can be calculated using Equation 2 above.

The strain energy of the panel is equal to the area under the graph of panel resisting force vs. midspan panel deflection up to the maximum allowable deflection, assuming the panel responds in both flexure and tensile membrane response to a concentrated load applied at midspan between supports. Tension and flexure interaction can be accounted for as stated in AISC 1995, Chapter H, except that no resistance factors need to be applied to the tensile and flexural strength of the panel. Panels adjacent to the impacted panel provide a compression strut that allows the impacted panel to respond in tension membrane. The tensile membrane strength will typically be limited by the capacity of the panel connections to develop tension in the panel, although it can also be limited by the tension capacity of the panel. The connection capacity should consider the bearing and edge tearout capacity around bolted connections. If bolted connections are used, a minimum of two bolted connections per side of each panel should be used. An 18-inch width of panel should be used to calculate all panel properties when determining the strain energy of the panel based on a comparison of calculated maximum and panel deflections measured during the full-scale tests. However, the connections over a 2 ft width, equal to the panel width, can be used to calculate the tensile restraint provided by the connections. The dynamic yield and ultimate strengths stated above in Table 7 can be used in all strain energy calculations.

FIG. 10 shows the calculated panel resisting force vs. midspan deflection in the lower curve. The strain energy at a maximum allowable deflection of 10.5 inches is 180 kip-in, which is equal to the area under the panel resisting force vs. midspan deflection curve (the lower curve in FIG. 10). If this energy is greater than the kinetic energy of the panel and fragment calculated in Equation 2, than the panel design is acceptable since the panel will absorb the applied kinetic energy with a deflection equal to, or less than the maximum allowable deflection. The upper curve FIG. 10 shows the tension membrane force in the panel peaks at 57 kips, based on the capacity of the panel connections. The tension force and moment capacity are assumed to remain constant at peak calculated values in a ductile manner out to the maximum allowable deflection. The full-scale tests showed that the minimum specified panel had sufficient shear strength to resist fragment impact near the supports, which is considered the worst case shear load. Therefore, no separate calculation is required to check the shear strength of the steel panel.

3. Column Design

The column should be constructed from a steel tube section with a minimum specified yield strength of 46 ksi. The column should have a minimum of 0.25-inch thick walls and minimum depth of 6 inches. The width of the column should not be greater than 4 inches to help ensure that both walls of the tube section help resist direct fragment impact on the column. The full scale proof test on an 8×4×0.25 TS column showed that the 8-inch depth was easily sufficient to prevent fragment penetration during direct impact.

The column must also absorb the energy applied by fragment impact near midspan acting as a one-way beam between supports without exceeding maximum allowable deflection criteria specified in Table 10. The overall response of the column is acceptable if the strain energy dissipated at the maximum allowable deflection is equal to, or greater than the kinetic energy imparted into the column by fragment impact. The kinetic energy of the column and fragment after impact can be calculated using Equation 6.

$$KE = \frac{0.5\, m_f^2 v_f^2}{g(m_f^2 + k_m(m_c + b_p m_p))} \qquad \text{Equation 6}$$

where

KE=kinetic energy of column and fragment after impact, $m_f$=weight of fragment, g=gravity constant, $v_f$=impact velocity of fragment, $m_c$=weight of column and attached parts (that is, angles or other connectors used to attach panel to column)

$m_p$=weight of tributary area of said panel laterally supported by column including all attached connector parts that move with said panel, $b_p$=panel mass participation factor (a value of 0.25 is preferred), $k_m$=effective mass factor for panel (a value of 0.41 is preferred);

The strain energy of the column is equal to strain energy absorbed by the panel in flexural response to a concentrated load applied at midspan between supports. The dynamic yield and ultimate strengths stated above in Table 7 can be used in all strain energy calculations. The available moment capacity used to calculate the strain energy absorbed by the column should not include the moment capacity required to resist the equivalent static load acting on the panel simultaneously with the fragment impact load. The strain energy can be calculated as shown in Equation 7 for the typical case of a column with simple supports. The maximum column deflection, $y_m$, can be calculated by setting the strain energy shown in Equation 7 equal to the kinetic energy in Equation 6.

$$SE = R_m\left(y_m - \frac{y_{el}}{2}\right) \qquad \text{Equation 7}$$

where $$R_m = \frac{4M_n}{L} \text{ in which } Mn = Zf_{dy} - \frac{W_d b_p L^2}{8} \text{ and } y_{el} = \frac{R_m}{K} \text{ in which } K = \frac{48EI}{L^3}$$

and where:

SE=strain energy absorbed by panel $R_m$=maximum load resistance of column with simple supports loaded at midspan K=stiffness of column with simple supports loaded at midspan $y_m$=maximum dynamic column deflection $y_{el}$=deflection of column at load equal to $R_m$ Mn=available dynamic moment capacity of column for fragment impact Z=plastic section modulus of column E=steel modulus of elasticity I=moment of inertia of column L=span of column between supports $f_{dy}$=dynamic yield strength of column steel (see Equation 1)

$w_d$=static design pressure acting simultaneously with fragment impact $b_y$=tributary width of panel supported by column The effect of axial load from self-weight of a barrier roof over oxygen handling equipment on the columns can be neglected. The columns should not subjected to additional column load unless absolutely necessary. If the columns are subjected to axial load greater than 2% of their axial capacity, the allowable maximum deflection from fragment impact should be reduced as described in Table 10.

Full-scale tests of an 8 inch deep tube steel column where fragment impact was applied right above a support showed that the column had sufficient shear strength to resist the fragment impact without being near failure. Therefore, the required minimum 6 inch deep tube steel column should also have sufficient shear strength to resist a worst case impact from the specified fragment. No shear calculations are required.

The column connections should be designed for the less severe shear load of the two following cases: 1) a maximum shear force of 130 kips that is based on the measured peak reaction during direct fragment impact on the column, 2) the maximum dynamic shear capacity of the column (Vcap) calculated with Equation 5.

4. Maximum Allowable Deflection Criteria

Table 10 shows recommended criteria for design of barriers against midspan fragment impact and blast load from the American Society of Civil Engineers (ASCE) for medium or moderate component response. The ductility ratio is calculated as shown in Equation 4. The more stringent of the ductility or the span to deflection criteria in Table 10 controls the maximum allowable deflection. The deflection criteria in Table 10 have approximately a safety factor of two compared to the maximum deflection that would cause panel or column failure. The columns of the barrier should not be subject to any unnecessary axial load. The criteria in Table 10 for axial load are intended primarily for one-story moment resisting frames, and therefore are not applicable for heavily loaded columns.

Any practical limits to maximum barrier deflection, such as the closest distance expected between the barrier and protected personnel, should also be considered. These practical limits could control compared to the maximum allowable deflection from Table 10, which only considers structural response. Also, in accordance with this invention, in an embodiment, the panel deflection should be limited so that it does not impact the fire panel on the non-impact side of the barrier, to prevent damage during fragment impact.

The barrier should have no windows. Doors may be constructed but should be constructed from corrugated steel panel and tube section framing as described above.

EXAMPLE

The following sets forth an example using the explanations and equations set forth above to illustrate the calculation methodology of this invention for designing a safety barrier for resisting an impact fragment of the one specified in the testing, namely one weighing 30 kg and traveling at 50 m/sec.

Example Problem

Design of Barrier to Resist Impact by Specified Fragment

| Description | Symbol | Value | Units |
|---|---|---|---|
| Fragment Input Values | | | |
| Fragment weight | $m_f$ | 66 | lbs |
| Fragment impact velocity | $v_f$ | 164 | ft/sec |
| Required Panel Inputs (Inputs for a 2" × 6" × 10 gage bridge deck panel) | | | |
| Effective panel width | $b_p$ | 18 | in |
| Total structural and fire panel weight | $w_p$ | 14.1 | lbs/ft$^2$ |
| Panel length | L | 96 | in |
| Material static yield stress | $F_{ys}$ | 50.0 | kips/in$^2$ |
| Material ultimate strength | $F_{us}$ | 70.0 | kips/in$^2$ |
| Elastic modulus | E | 29000.0 | kips/in$^2$ |
| Section modulus over effective panel width ($b_p$) (Note: Panel properties given over 2 ft width) | S | 3.1 $b_p$/24 | in$^3$ |
| Moment of inertia over effective panel width ($b_p$) | I | 3.1 $b_p$/24 | in |
| Cross sectional area over effective panel width ($b_p$) | A | 4.7 $b_p$/24 | in |
| Material thickness | t | 0.135 | in |
| Diameter of bolts attaching panel to column | d | 0.875 | in |
| Bolt edge distance | $L_e$ | 2.6 | in |
| Bolt ultimate shear strength | $V_b$ | 36 | kip |
| Number of bolts over full panel width | $N_b$ | 2 | |
| Dynamic Increase Factor for yield strength for high strain rate effects (c) | DIFY | 1.19 | |
| Yield strength Increase Factor for average vs. minimum material properties (a) | SIFY | 1.10 | |
| Dynamic Increase Factor for ultimate strength for high strain rate effects | DIFU | 1.05 | |
| Dynamic Increase Factor for ultimate strength for high strain rate effects | SIFU | 1.0 | |
| Maximum allowable ductility | $\mu_p$ | 10 | |
| Maximum allowable deflection to span ratio | $dl_p$ | 0.12 | |
| Required Column Inputs (Inputs for a 8 × 4 × 0.25" TS column w/attached 6 × 4 × ⅜" angle) | | | |
| Column span length | $L_c$ | 112 | in |
| Material static yield stress | $F_{yc}$ | 46.0 | Kips/in$^2$ |

-continued

| Description | Symbol | Value | Units |
|---|---|---|---|
| Dynamic Increase Factor for yield strength for high strain rate effects | $DIFY_c$ | 1.19 | |
| Yield strength Increase Factor for average vs. minimum material properties | $SIFY_c$ | 1.10 | |
| Tributary width of panel supported by column | $b_t$ | 48 | in |
| Elastic modulus | $E_c$ | 29000.0 | kips/in$^2$ |
| Plastic section modulus | $Z_c$ | (14.1 + 2.85) | in$^3$ |
| Elastic section modulus | $S_c$ | (11.1 + 1.6) | in$^3$ |
| Moment of inertia | $I_c$ | (45.0 + 4.9) | in$^4$ |
| Effective panel width deflecting with column | $b_c$ | 24 | in |
| Column weight | $w_c$ | 19+ 12.3 | lbs/ft |
| Web area (angle leg may be included if they extend to support) | $A_V$ | 4.0 | in$^2$ |
| Maximum allowable ductility | $\mu_c$ | 10 | |
| Maximum allowable deflection to span ratio | $Dl_c$ | 0.055 | |
| PANEL CALCULATIONS Kinetic Energy of Fragment and Panel | | | |
| Gravity constant | g | 386 | in/sec$^2$ |
| Effective mass factor for panel mass | $k_m$ | 0.33 | |
| Total effective panel weight $M_{ep} = k_m w_p b_p L/144$ | $M_{ep}$ | 55.836 | lb |
| Kinetic energy of panel and fragment after impact | KE | 179.368 | Kip-in |

$$KE = \frac{0.5 m_f^2 (v_f 12)^2}{(M_{ep} + m_f) \cdot g \cdot 1000}$$

| Structural Panel Properties Ultimate strength Increase Factor for average vs. minimum material properties | | | | |
|---|---|---|---|---|
| Dynamic yield strength | $F_{dy} = F_{ys} \cdot DIFY \cdot SIFY$ | $F_{dy}$ | 65.450 | kips/in$^2$ |
| Dynamic ultimate strength | $F_{du} = F_{us} \cdot DIFU \cdot SIFU$ | $F_{du}$ | 73.500 | kips/in$^2$ |

Section Capabilities, Stiffness and Resistance

Section capacities are calculated in accordance with the AISC specifications for hot rolled steel sections.

| Item | Equation | Symbol | Value | Units |
|---|---|---|---|---|
| Bolt material connection strength | $P_b = if[(3 \cdot t \cdot d) \cdot (F_{du})\ L_e \cdot t \cdot F_{du}, (3 \cdot t \cdot d) \cdot (F_{du}), \cdot L_e \cdot t \cdot F_{du}]$ | | | |
| Overall Connection Strength | $B = if\ (P_b\ V_b, P_b, V_b)$ | $P_b$ | 25.799 | kips |
| Axial panel capacity at support | $P = N_b \cdot P_b$ | P | 51.597 | kips |
| Axial capacity at max moment | $P_{mm} = A \cdot F_{dy}$ | $P_{mm}$ | 230.711 | kips |
| Moment capacity | $M_n = S - F_{dy}$ | $M_n$ | 152.171 | in-kips |
| Elastic flexural stiffness | $Ke = \frac{48 \cdot E \cdot I}{r^3}$ | Ke | 3.658 | Kips/in |
| Natural Period of Response | $Tn = 2 \cdot 3.1417\left(\frac{1000 \cdot M_{ep}}{K_e \cdot g}\right)$ | Tn | 3.39512 | msec |

-continued

| Item | Equation | Symbol | Value | Units |
|---|---|---|---|---|
| Initial Flexural Response | $Rm = \frac{4(M_n)}{L}$ | Rm | 6.340 | kips |
| Flexural yield deflection | $y_{el} = \frac{Rm}{Ke}$ | $y_{el}$ | inches | |
| Maximum deflection based on ductility | $Y_{m1} = y_{el} \cdot \mu_p$ | | | |
| Maximum deflection based on support rotation | $Y_{m2} = dl_p \cdot L$ | | | |
| Maximum allowable deflection | $y_{allow} = if(y_{m2} < Y_{m1}, Y_{m2} \cdot y_{m1})$ | $y_{allow}$ | 11.520 | inches |
| Set up indices for range variables | $N = 50$ | $i = 1, 2 \ldots N$ | | |
| Define a range of values for midspan deflection | $y_{omax} = y_{allow}$ <br> $y_{o_i} = \frac{y_{omax}}{N-1} \cdot (i-1)\Big)$ <br> Check: $y_{o_1} = 0.000$ in <br> $y_{o_N} = 11.520$ in | | | |
| This equation defines the relationship between $y_o$, F and P where $F = w \cdot L$ | $y_o + \frac{A}{4 \cdot I} \cdot y_o^3 = \frac{2 \cdot F \cdot L^3}{(\pi^4) \cdot E \cdot I}$ | | | |

For now, the member is assumed to remain elastic. Then, the applied force F and internally generated axial tensile force P are calculated in terms of a range variable $y_o$ as follows:

$$F_i = \frac{(\pi^4) \cdot E \cdot I \cdot \left[y_{o_i} + \frac{A}{4 \cdot I}\right] \cdot (y_{o_i})^3}{2 \cdot L^3} \quad P_i = \frac{\pi^2 \cdot E \cdot A}{4 \cdot L^2} \cdot (y_{o_i})^2$$

The bending moments at midspan, assuming elastic response are $$M_i = \left(\frac{F_i \cdot L}{4} - P_i \cdot y_{o_i}\right)$$

Axial Load—Moment Interaction and Resistance Factor

AISC Specifications for hot rolled steel sections specify a linear interaction relationship for determining section capacities under simultaneous application of axial load and moment as follows. Material nonlinear effects are also considered by limiting the maximum axial force, P, to the tensile capacity, $P_n$, and using equilibrium equations to calculate the midspan moment in terms of applied load. The midspan moment is limited to a maximum value, $M_{np}$ calculated above which takes into account effects of axial load and moment interaction.

$$P/P_n + (8/9)(M/M_n) = 1.0 \text{ for } P/P_n \geqq 0.2 \text{ and}$$

$$P/P_n + M/\phi M_n = 1.0 \text{ for } P/P_n \geqq 0.2$$

$$\text{If } P_{nli} = if(P_i \leqq P_n, P_l, P_n)$$

Bi-Linear Interaction Equation $$POP_{n_i} = \text{if}\left(P_i \leq P_n, \frac{P_i}{P_n}, 1.0\right) \quad POP_{mm_i} = \text{if}\left(P_{nl_i} \leq P_{mm}, \frac{P_{nl_i}}{P_{mm}}, 1.0\right)$$

$$M_{np_i} = \left[POP_{mm_i} \geq 0.20, M_n \cdot (1.0 - POP_{mm_i}) \cdot 9/8, M_n\left(1.0 - \frac{POP_{mm_i}}{2}\right)\right]$$

Resistance Function $$F_{nl_i} = \text{if}\left[\frac{F_i \cdot L}{4} - P_{nl_i} \cdot y_{o_i} \leq (M_{npi} + P_{nl_i} \cdot y_{o_i}) \cdot \frac{4}{L}\right]$$

Strain Energy Function

The area under the applied load versus displacement curve equals the strain energy capacity, SE, of the member which is calculated as follows:

$$SE = \sum_{n=1}^{N-1} 0.5(y_{o_{n+1}} - y_{o_n}) \cdot (F_{nl_n} + F_{nl_{n+1}})$$

SE=201.522 in-kips

Check on Panel Design (Compare SE to KE to see if panel design is acceptable)

Ideally, Efactor (see formula below) should be greater than 0 indicating that the strain energy at the maximum allowable deflection can absorb all the applied kinetic energy. However, if Efactor is greater than −0.1 (that is, within 10% of the case where strain energy absorbs all the applied kinetic energy), the result is acceptable for design.

$$Efactor = \frac{(SE - KE)}{KE}$$

Efactor=0.124

Column Design Calculations
Definition of Analysis Parameters

| Item | Equation | Symbol | Value | Units |
|---|---|---|---|---|
| Effective mass factor for panel and column mass | | $m_e$ | 0.41 | |
| Total effective column weight | $M_{ec} = \left[\frac{(w_p \cdot b_c)}{12} + w_c\right] \cdot \frac{L_c}{12}$ | $M_{ec}$ | 227.687 | lb |
| Kinetic energy of column and fragment after impact | $KE = \frac{\lfloor 0.5 \cdot m_f^2 \cdot (v_f \cdot 12)^2 \rfloor}{(M_{ec} + m_f) \cdot g \cdot 1000}$ | KE | 74.441 | Kip-in |

Section Dynamic Properties and Maximum Column Deflection

Section capabilities are calculated in accordance with the AISC specifications for hot rolled sections.

| Item | Equation | Symbol | Value | Units |
|---|---|---|---|---|
| Dynamic yield strength | $F_{dy} = F_{yc} \cdot DIFY_c \cdot SIFY_c$ | $F_{dy}$ | 60.214 | kips/in$^2$ |
| Moment capacity | $M_{n_c} = Z_c \cdot F_{dy}$ | $M_n$ | $1.021 \cdot 10^3$ | in-kips |
| Elastic flexural stiffness | $K_e = \frac{48 \cdot E_c \cdot I_c}{L_c^3}$ | $K_e$ | 49.441 | kips.in |
| Natural period of response | $T_n = 1 \cdot 3.1417 \cdot \left(\frac{1000 \cdot M_{ec}}{K_e \cdot g}\right)^{0.5}$ | $T_n$ | 21.703 | msec |
| Flexural resistance | $R_{mo} = \frac{4(M_n)}{L_e}$ | $R_{mo}$ | 36.451 | kips |
| Flexural yield deflection | $y_{el} = \frac{R_{mo}}{K_e}$ | $y_{el}$ | 0.737 | inch |
| Maximum column deflection | $y_m = \frac{KE}{R_{mo}} + \frac{y_{el}}{2}$ | $y_m$ | 2.410 | inches |

Check on Column Design (Compare max. acceptable and max. calculated deflections to see if column design is acceptable. Column design is acceptable if y-comp>0.)

| Item | Equation | Symbol | Value | Units |
|---|---|---|---|---|
| Maximum deflection based on ductility | $y_{m1} = Y_{el} \cdot \mu_c$ | | | |
| Maximum deflection based on support rotation | $y_{m2} = dl_c \cdot L_c$ | | | |
| Maximum allowable deflection | $y_{allow_c} = if(y_{m2} < y_{allow_c}\ y_{m1}, y_{m2} \cdot y_{m1})$ | | 6.160 | inches |
| Max deflection check | $y_comp = y_{allow_c} - y_m$ | Y_comp | 3.750 | inches |

Maximum Column Reaction Force

| Item | Equation | Symbol | Value | Units |
|---|---|---|---|---|
| Maximum force on connections for case 1 in specifications | | $V_1$ | 130 | kips |
| Maximum force on connections in case 2 in specifications | $V_{cap} = 0.55 \cdot F_{dy} \cdot A_v$ | $V_{cap}$ | 132.471 | kips |
| Maximum reaction force | $V_{cap} = if(V_1 < V_{cap}, V_1, V_{cap})$ | $V_{max}$ | 130 | kips |

Having now described the methodology of testing and barrier design encompassed by this invention and barriers for protection of facilities both from blast fragment impact and from an oxygen fire, our invention is not to be limited by the specific details and embodiments described, but is defined by the scope of the invention as set forth in the appended claims

We claim:

1. A method of designing a safety barrier to protect a facility from a blast fragment of specified weight moving at a specified velocity, comprising:

(a) selecting a corrugated impact panel having a thickness, rib height, rib spacing, and yield strength for and selecting a tubular column having a yield strength, wall thickness, depth and width, (b) directly impacting a barrier comprising said impact panel connected to and spanning a pair of said columns with said fragment of said specified weight at an allowable range of variance of said specified velocity to obtain test values including at least peak column reaction loads from such direct impact of said fragment on said column, (c) calculating whether such impact panel is capable of (i) absorbing kinetic energy (KE) applied by a midspan impact of said fragment, said impact panel acting as a one-way beam, without exceeding the more stringent of a predetermined maximum allowable ductability ratio and a predetermined maximum allowable deflection to span ratio for said impact panel, and (ii) dissipating a strain energy (SE) imparted into the impact panel at such maximum allowable deflection such that the ratio $$\frac{(SE - KE)}{KE}$$

is greater than minus 0.1 and if so, accepting the impact panel for use in a safety barrier, (d) calculating whether said column is capable of (i) absorbing kinetic energy energy applied by midspan fragment impact, said column acting as a one-way beam, without exceeding the more stringent of a predetermined maximum allowable ductability ratio and a predetermined maximum allowable deflection to span ratio for said column, and (ii) dissipating strain energy at maximum allowable deflection, and if so accepting the column for use in a safety barrier with said impact panel, (e) determining whether connectors for connecting said impact panel to said columns having sufficient shear strength considering the lesser of (i) maximum dynamic shear capacity of said column ($V_{cap}$) and (ii) a maximum dynamic shear force based on measured peak reaction during direct fragment impact on the column, and if so, accepting said connectors for use with said impact panel and columns in said safety barrier.

2. A safety barrier designed in accordance with the method of claim 1 comprising an accepted impact panel, a pair of accepted columns and accepted connectors, said impact panel being connected to and spanning a pair of said columns.

3. The safety barrier of claim 2 further comprising at least one oxygen fire resistant panel spaced from said impact panel a distance in excess of the maximum allowable deflection of said impact panel.

4. The safety barrier of claim 3 in which said t oxygen fire resistant panel is tested for burn-through resistance by holding a test material outside a predetermined position for testing resistance of the material to burn-through, igniting to constant burn an exothermic burning bar having an oxygen exhaust end facing said predetermined position, moving said test material into said predetermined position, and advancing said ignited exothermic burning bar toward the test material at a speed effective to maintain the end of the burning bar at a constant predetermined spacing from the test material in said predetermined test position, and found to resist burn through for a predetermined suitable time.

5. The safety barrier of claim 3 in which said predetermined position presents said test material in a plane substantially perpendicular to the oxygen exhaust end of said burning bar.

6. The safety barrier of claim 3 in which said test material is lowered into said test position from a height over said test position.

7. The safety barrier of claim 2 further comprising at least one oxygen fire resistant panel in which said selected from steel clad panel and fiber cement board panels on the non-blast side of said impact panel, spaced from said impact panel a distance in excess of the maximum allowable deflection of said impact panel.

8. The safety panel of claim 3 further comprising at least one oxygen resistant panel selected from steel clad panel and fiber cement board panels supported on a blast side of said impact panel.

9. The safety barrier of claim 2 capable of resisting end on penetration of a fragment weighing about 30 kg traveling at about 50 m/sec.

10. The safety barrier of claim 2 in which said impact panel is a corrugated steel panel having a steel minimum yield strength of about 50,000 psi, a minimum panel thickness of about 0.135 inches, a minimum panel rib height of about 2 inches and a maximum panel rib spacing of about 6 inches.

11. The safety barrier of claim 2 in which said steel tube columns each have a minimum wall thickness of about 0.25 inch, a minimum depth of about 6 inches, and a maximum width of about 4 inches.

12. A method of protecting a facility from a blast fragment of specified weight moving at a specified velocity, comprising designing a safety barrier in accordance with claim 1 and installing, between equipment which can be the source for a blast fragment and the facility to be protected, said barrier comprising an accepted panel, a pair of accepted columns and accepted connectors, said panel being connected to and spanning a pair of said columns.

13. The method of claim 12 in which said facility includes a centrifugal oxygen compressor and wherein said method further comprises protecting said facility from an oxygen fire, said barrier further comprising at least one oxygen fire resistant panel selected from steel clad panel and fiber cement board panels on the non-blast side of said impact panel, spaced from said impact panel a distance in excess of the maximum allowable deflection of said impact panel.

14. The method of claim 13, in which said safety barrier further comprising at least one oxygen resistant panel selected from steel clad panel and fiber cement board panels supported on a blast side of said impact panel.

15. A method of designing a safety barrier to protect a facility from a blast fragment of specified weight moving at a specified velocity, comprising:

(a) selecting a corrugated panel having a thickness, rib height, rib spacing, and yield strength for and selecting a tubular column having a yield strength, wall thickness, depth and width, (b) directly impacting a barrier comprising said panel connected to and spanning a pair of said columns with said fragment of said specified weight at an allowable range of variance of said specified velocity to obtain test values including at least peak column reaction loads from such direct impact of said fragment on said column, (c) calculating whether the panel of such is capable of (i) absorbing kinetic energy ($KE_p$) applied by a midspan impact of said fragment, said panel acting as a one-way beam, without exceeding the more stringent of a predetermined maximum allowable ductability ratio and a predetermined maximum allowable deflection to span ratio, and (ii), at such maximum allowable deflection, dissipating a strain energy ($SE_p$) equal to or greater than kinetic energy imparted into the panel by fragment impact according to the equation for kinetic energy of the panel and the fragment after plastic impact by the fragment, as follows:

$$KE_p = \frac{0.5m_f^2 v_f^2}{g(m_f^2 + k_m m_p)}$$

where $KE_p$=kinetic energy of panel and fragment after impact, $m_f$=weight of fragment, $v_f$=impact velocity of fragment, $m_p$=weight of 18 inch width of panel, including all attached connector parts that move with the panel, g=gravity constant, $k_m$=effective mass factor for panel;

such that the ratio $$\frac{(SE_p - KE_p)}{KE_p}$$

is greater than minus 0.1 and if so, accepting the panel for use in a safety barrier, (d) calculating whether said column is capable of (i) absorbing kinetic energy energy applied by midspan fragment impact, said column acting as a one-way beam, without exceeding the more stringent of a predetermined maximum allowable ductability ratio and a predetermined maximum allowable deflection to span ratio for said column, and (ii) dissipating strain energy at maximum allowable deflection equal to or greater than kinetic energy imparted into a column by fragment impact, said kinetic energy being determined according to the equation $$KEc = \frac{0.5m_f^2 v_f^2}{g(m_f^2 + k_m(m_c + b_p m_p))}$$

where $KE_c$=kinetic energy of column and fragment after impact, $m_f$=weight of fragment, g=gravity constant, $v_f$=impact velocity of fragment, $m_c$=weight of column and attached parts $m_p$=weight of tributary area of said panel laterally supported by column including all attached connector parts that move with said panel, $b_p$=panel mass participation factor, $k_m$=effective mass factor for panel; and p2 and if so, accepting the column for use in a safety barrier with said panel, (e) determining whether connectors for connecting said panel to said columns having sufficient shear strength considering the lesser of (i) a maximum dynamic shear force based on measured peak reaction during direct fragment impact on the column, and (ii) maximum dynamic shear capacity of said column as calculated according to the equation:

$$V_{cap}=0.55\, f_{dy} A_v$$

where $V_{cap}$=dynamic shear capacity of column $f_{dy}$=dynamic yield strength of column steel, and $A_v$=web area of column and said attached connectors resisting shear at the support, and if so, accepting said connectors for use with said panel and columns in said safety barrier.

16. The method of claim 15 in which said panel is corrugated steel and said predetermined maximum allowable deflection criteria of said panel panel are equal to the more stringent of (i) a maximum ductility ratio of 10 and (ii) a maximum deflection to span ratio of 12%.

17. The method of claim 15 in which said column is tubular steel and said predetermined maximum allowable deflection criteria of said column is equal to the more stringent of (i) a maximum ductility ratio of 3, if axial load exceeds 2% of axial capacity, or of 10, if axial load does not exceed 2% of axial capacity, and (ii) a maximum deflection to span ratio of 1.7%, if axial load exceeds 2% of axial capacity, or 5.5%, if axial load does not exceed 2% of axial capacity; said maximum ductility ratio and said maximum deflection to span ratios being determined according to the equation:

$$\mu = \frac{y_m}{y_{el}}$$

where $\mu$=ductility ratio $y_m$=maximum dynamic component deflection $y_{el}$=deflection causing yielding in component at all maximum moment regions.

* * * * *

UNITED STATES PATENT AND TRADEMARK OFFICE

CERTIFICATE OF CORRECTION

PATENT NO. : 6,873,920 B2
DATED : March 29, 2005
INVENTOR(S) : Kim Dunleavy and Charles J. Oswald It is certified that error appears in the above-identified patent and that said Letters Patent is hereby corrected as shown below:

Column 38,
Line 13, please delete the words “in which said”.

Column 40,
Line 6, please delete the words “and p2”.
Line 29, please delete the second “panel”.

Signed and Sealed this

Thirty-first Day of May, 2005

JON W. DUDAS
*Director of the United States Patent and Trademark Office*